US009681732B2

(12) United States Patent
Winter et al.

(10) Patent No.: US 9,681,732 B2
(45) Date of Patent: Jun. 20, 2017

(54) BOTTLE CAP WITH COSMETIC KIT

(71) Applicant: Tali Corp., San Francisco, CA (US)

(72) Inventors: Tal Winter, San Francisco, CA (US); Imraan Aziz, Oakland, CA (US); Thomas E. King, San Francisco, CA (US); Michael J. Strasser, San Francisco, CA (US); William G. Tammen, Redwood City, CA (US); Kyle Lamson, San Francisco, CA (US)

(73) Assignee: Tali Corp., San Francisco, CA (US)

( * ) Notice: Subject to any disclaimer, the term of this patent is extended or adjusted under 35 U.S.C. 154(b) by 0 days.

(21) Appl. No.: 14/872,113

(22) Filed: Sep. 30, 2015

(65) Prior Publication Data

US 2016/0157583 A1 Jun. 9, 2016

Related U.S. Application Data

(63) Continuation-in-part of application No. 14/616,645, filed on Feb. 6, 2015, now Pat. No. 9,346,595.
(Continued)

(51) Int. Cl.
*A45D 40/18* (2006.01)
*A45D 34/00* (2006.01)
(Continued)

(52) U.S. Cl.
CPC ..... *A45D 40/18* (2013.01); *A45D 33/00* (2013.01); *A45D 33/003* (2013.01);
(Continued)

(58) Field of Classification Search
CPC .... B65D 51/28; B65D 51/2807; B65D 51/24; B65D 51/18; B65D 25/325; B65D 25/32;
(Continued)

(56) References Cited

U.S. PATENT DOCUMENTS 1,242,994 A 10/1917 Skiff
1,487,576 A * 3/1924 Kendall ..... A45D 33/003 132/295
(Continued)

FOREIGN PATENT DOCUMENTS

EP 1743546 A1 1/2007
KR 1020120132141 A 12/2012
(Continued)

OTHER PUBLICATIONS

Sanchez, "AVEX Autospout Water Bottle Review", "https://web.archive.org/web/20130513215212/http://www.freshairjunkie.com/index.php/2013/04/avex-autospout-water-bottle-review/", May 13, 2013, Publisher: Wayback Machine, Published in: US.
(Continued)

*Primary Examiner* — Robert J Hicks
(74) *Attorney, Agent, or Firm* — Loginov & Associates; William A. Loginov

(57) ABSTRACT

A cap for a reusable bottle and a compound-containing container is provided. The container is a separate, replaceable structure with a base (well/bowl) section containing the compound and a hinged or otherwise removable cap. The container is secured in a cavity in the top of the cap using appropriate detents that flex based upon the materials inherent resilient (e.g. a polymer material) to selectively engage with and disengage from the cap cavity. The cap can include a (unitary or integral) hook or ring that extends from the edges of the cap and can provide a stop that the lid of the secured container hinges against when placed in an open position. The hinge includes a detent adjacent to its front edge (opposite the side containing the hinge. This detent retains the lid in a closed position, but can be overcome by pressure applied by the user to open the lid.

11 Claims, 28 Drawing Sheets

Related U.S. Application Data

(60) Provisional application No. 62/059,137, filed on Oct. 2, 2014.

(51) Int. Cl.

| | |
|---|---|
| ***A45D 33/00*** | (2006.01) |
| ***A45D 40/00*** | (2006.01) |
| ***A45D 40/22*** | (2006.01) |
| ***A45F 3/16*** | (2006.01) |
| ***B65D 43/16*** | (2006.01) |
| ***B65D 51/18*** | (2006.01) |
| ***B65D 51/28*** | (2006.01) |
| ***A45D 33/26*** | (2006.01) |
| ***A45F 3/18*** | (2006.01) |

(52) U.S. Cl.

CPC ..... *A45D 33/006* (2013.01); *A45D 33/26* (2013.01); *A45D 34/00* (2013.01); *A45D 40/00* (2013.01); *A45D 40/22* (2013.01); *A45F 3/16* (2013.01); *A45F 3/18* (2013.01); *B65D 43/16* (2013.01); *B65D 51/18* (2013.01); *B65D 51/28* (2013.01); *B65D 2251/009* (2013.01); *B65D 2251/0021* (2013.01); *B65D 2251/0028* (2013.01)

(58) Field of Classification Search

CPC .... B65D 25/28; B65D 41/04; B65D 41/0485; A45D 40/222; A45D 40/22; A45D 40/18; A45D 40/24; A45D 42/02; A45D 33/00; A45D 33/003; A45D 33/26; A45D 34/00; A45F 3/16

USPC ..... 215/227, 228, 243, 237, 235, 397, 396; 220/212, 254.3, 259.1, 522, 521, 212.5, 220/740, 756, 839, 837, 836, 810, 324, 220/315; 206/581; 16/425

See application file for complete search history.

(56) References Cited

U.S. PATENT DOCUMENTS

| | | | | |
|---|---|---|---|---|
| 2,565,076 | A * | 8/1951 | Haubrick | A45C 3/06 132/296 |
| 4,165,815 | A | 8/1979 | Vetter | |
| 6,478,155 | B2 | 11/2002 | Bunyan | |
| 7,055,709 | B1 | 6/2006 | Esau | |
| 7,337,497 | B2 | 3/2008 | Seidler et al. | |
| 7,503,453 | B2 | 3/2009 | Cronin et al. | |
| 7,854,104 | B2 | 12/2010 | Cronin et al. | |
| D672,609 | S | 12/2012 | Aziz et al. | |
| 2006/0016819 | A1 | 1/2006 | Paslawski et al. | |
| 2006/0191932 | A1 | 8/2006 | Bocola | |
| 2007/0205176 | A1 | 9/2007 | Karp | |
| 2007/0284329 | A1 * | 12/2007 | Hayes | A61J 9/00 215/11.1 |
| 2010/0294739 | A1 | 11/2010 | Morris, III et al. | |
| 2012/0145713 | A1 | 6/2012 | Jung | |

FOREIGN PATENT DOCUMENTS

| | | | |
|---|---|---|---|
| KR | 101271359 | B1 | 6/2013 |
| WO | 2006034162 | A1 | 3/2006 |

OTHER PUBLICATIONS

Freshwatersystems.Com, "Lid With Pour Cap and Handle for 1 Gallon Glass Jar Turquoise Splash", "https://web.archive.org/web/20140414025953/http://www.freshwatersystems.com/p-8398-lid-with-pour-cap-and-handle-for-1-gallon-glass-jar-turquoise-splash.aspx", Apr. 14, 2014, Publisher: Wayback Machine, Published in: US.

Maria, "Lifefactory Glass Beverage Bottles", "https://web.archive.org/web/20120302222842/http://change-diapers.com/2012/02/lifefactor-glass-beverage-bottles", Mar. 2, 2012, Publisher: Wayback Machine, Published in: US.

* cited by examiner

BOTTLE CAP WITH COSMETIC KIT

RELATED APPLICATIONS

This application is a continuation-in-part of co-pending U.S. patent application Ser. No. 14/616,645, filed Feb. 6, 2015, entitled BOTTLE CAP WITH COSMETIC KIT, the entire disclosure of which is herein incorporated by reference, which claims the benefit of U.S. Provisional Application Ser. No. 62/059,137, filed Oct. 2, 2014, entitled BOTTLE CAP WITH COSMETIC KIT, the entire disclosure of each of which applications is herein incorporated by reference.

FIELD OF THE INVENTION

This invention relates to a cap for bottles and more particularly to a cap that includes container for storing useful compounds.

BACKGROUND OF THE INVENTION

Active lifestyles are mobile lifestyles, and water remains an essential part of life, so portable and safe liquid vessels are a part of modern life. Renewable and reusable water vessels offer and environmentally friendly alternative to the ubiquitous disposable plastic bottle. While convenient when introduced, the plastic bottle is now recognized as wasteful. Simple water can now be transformed into sports drinks and energy supplements by the introduction of concentrated additives. Another problem with conventional plastic bottles is the health risk posed by the various chemical ingredients used in creating the bottles. Some of the chemical components can pass into the contained liquids by a leaching process, placing the health of the consumer at risk. This can be particularly troublesome to the health conscious consumer.

A glass bottle is refillable, reusable and can be cleaned as needed. Glass vessels are not prone to contaminating the contents by leaching. Glass containers, which are predominantly silicon-dioxide structures, are stable and relatively free from contamination of their contents. However, glass bottles can be slippery to hold and are prone to breakage if dropped.

Users of (reusable) glass bottles can find themselves with dry lips. Lip glosses and lip balms are conventional remedies for dry lips. However, water bottle use can remove lip gloss. Women who use the bottle can find themselves needing more lip gloss or another cosmetic to maintain their appearance. Examples of cosmetics are base creams, eye shadow, eye liners, blushes and the like. Moreover compounds, such as lip glosses, balms, etc. can be consumed relatively quickly and replacement of such compounds in a cost effective and efficient manner is highly desirable.

SUMMARY OF THE INVENTION

The present invention overcomes the disadvantages of the prior art by providing a cap for a bottle containing a cosmetic reservoir. The cap is cylindrical and defines an inner volume containing at least one reservoir for cosmetics, the reservoir being accessible when the lid is opened and inaccessible when the lid is closed. The reservoir is refillable and can be a removable tray. A cap for a bottle is comprised of a threaded section for engaging with the bottle; a reservoir chamber for receiving a cosmetic; a barrier wall disposed between the threaded section and the reservoir chamber; a lid configured to enclose the reservoir chamber and to provide selective access to the cosmetic kit. The cosmetic received within the reservoir chamber can be depleted and subsequently refilled. The reservoir chamber can receive a removable tray, the removable tray being configured to receive the cosmetic. The reservoir chamber can comprise a dividing wall that defines a plurality of distinct reservoir chambers for receiving a plurality of cosmetics. At least two reservoirs can be stacked, one upon the other. The cap is provided with a handle set at an angle relative to the cap that acts as a stop to the lid. A method for carrying and dispensing cosmetics within a cap for a bottle is comprised of the steps of opening a lid and filling a cosmetic reservoir within the cap with a cosmetic; opening the lid to access and remove a portion of the cosmetic from the cosmetic reservoir; and applying the cosmetic; and closing the lid. The opening of the lid is stopped by contact with the handle. The closing of the lid creates an annular seal to contain the enclosed cosmetics. The handle is off set at an angle of 60 degrees relative to the cap. A bottle system is comprised of a bottle for receiving a liquid; a sleeve that receives the bottle; and a cap, the cap is comprised of a threaded section for engaging with the bottle; a reservoir chamber for receiving a cosmetic; a barrier wall disposed between the threaded section and the reservoir chamber; a lid configured to enclose the reservoir chamber and to provide selective access to the cosmetic kit.

In a further embodiment, a cap for a reusable bottle (e.g. a glass bottle with resilient sleeve) provides a cap with a compound-containing (e.g. cosmetic) container in which the container is provided as a separate, replaceable structure with a base (well/bowl) section containing the compound and a hinged or otherwise removable cap. The container is secured in a cavity in the top of the cap using appropriate detents that flex based upon the materials inherent resilient (e.g. a polymer material) to selectively engage with and disengage from the cap cavity. The cap can include a (unitary or integral) hook or ring that extends from the edges of the cap and can provide a stop that the lid of the secured container hinges against when placed in an open position. The hinge is illustratively free of a spring and hinges freely between the open close and open position. The hinge can also include a detent adjacent (e.g.) to its front edge (opposite the side containing the hinge. This detent retains the lid in a closed position, but can be overcome by pressure applied by the user to open the lid, thus making the compound accessible to the user for application to his/her body or another location.

In an illustrative embodiment, a cap for a bottle (that can include a threaded enclosure, be constructed of glass and/or be covered with an elastomeric sleeve) is provided. The cap includes a cap body having a base for engaging a top of the bottle and a cavity for receiving a removable tray adapted for containing a dispensable material for use by a user. A lid is hingedly attached to the tray by a hinge assembly, whereby the lid moves selectively between a closed position and an open position. An interengaging retaining structure that removably secures the tray in the cavity. Illustratively, the hinge is free of springs, and can use a separate or unitary axle arrangement (unitary including (e.g.) opposing protrusions and detents in each respective part of the hinge). The lid can further comprise a hinge leaf and a loop within the hinge leaf, and wherein the tray can further comprise a hinge anchor. The hinge can also define, collectively, the lid, the tray, and a hinge pin, wherein the hinge is integral. Illustratively, the interengaging retaining structure can define a rabbet within the cavity, and the interengaging retaining structure can further define a tooth extending from the tray, which is adapted to engage within the rabbet, whereby the tooth (or other projection) and the rabbet (or other projection, slot, shelf, etc.) are adapted for securing the tray to the cap. The interengaging retaining structure can further comprise a notch within the cavity, and the interengaging retaining structure can further comprise a detent extending from the tray, which is adapted to engage within the notch, whereby the detent and the notch are adapted for securing the tray to the cap. The lid can also be secured to the tray in the closed position by a snap fit, which is free of non-unitary components. In various embodiments, the tray can further comprise a septum that separate the tray into at least two bowls. The two bowls can be adapted to contain different materials or items from each other. Illustratively, a surface that defines the cavity can further define a gap in the cavity for the hinge, thereby setting the rotational position of the tray within the cavity. In various embodiments, the cap can further comprise a handle (unitary or integral) that extends from the cap. In various embodiments, the handle can positioned to form a stop to the lid in an open position. In embodiments, the handle defines a loop. The tray can be filled with a material and/or at least one small item (e.g. jewelry, pills, etc.). Illustratively, the tray is replaceable, and replacement trays can be selectively fitted upon removal of the tray from the cap. Such trays can include a new supply of a material. Replacement trays can include the tooth (or other projection) adapted for securing the tray to the cap.

In another illustrative embodiment, a compact kit adapted for securing to a bottle cap or other object is provided. The kit includes a tray, in which the tray defines generally a bottom plate and a sidewall. A hinged lid is also provided to the kit, with integral hinge that defines a rear portion of the kit. A tooth or other projection extends from a front portion of the kit and is adapted to engage within a rabbet (or other projection, shoulder, etc.) in the cap, so as to secure the kit to the cap. Illustratively, the hinge is free of springs and the lid can include a hinge leaf and a loop within the hinge leaf. The tray can further comprise a hinge anchor, wherein the hinge comprises the lid, the tray, and a hinge pin. The tray can also include at least one detent extending from the rear portion of the kit, which is adapted to engage within at least one corresponding notch in the cap, for securing the kit to the cap. Illustratively, the lid can be secured to the tray in the closed position by a snap fit free of non-unitary components. In various embodiments, the tray further comprises a septum that separates the tray into at least two bowls. The two bowls can be adapted to contain different materials or items with respect to each other. The hinge can be adapted to be housed within a gap in the cap, thereby setting the rotational position of the tray within the cap. Illustratively, the tray can be filled with a material and/or or at least one small item. In various embodiments, the kit is replaceable, and replacement kits are adapted to be secured within the cap.

In another illustrative embodiment, a tray for use typically with a bottle cap is provided. The tray defines a sidewall and a rear attachment region, the rear attachment region comprises at least one detent or notch. The try further includes a front engagement region that comprises at least one tooth (or other projection) that extends distally outward from a lower region of the sidewall. Illustratively, at least one detent or notch is located within a range of between approximately 0.18 inch and approximately 0.23 inch from a bottom of the tray. The sidewall can define an outer circumference with a diameter of approximately 1.75 inch. Illustratively, the tooth can extend distally outward from the circumference of the tray in a range of between approximately 0.010 inch to approximately 0.030 inch outward. In embodiments, the tray can further comprise a rear hinge area having at least two hinge anchors. The hinge anchors can define a maximum hinge width of approximately 0.56 inch

BRIEF DESCRIPTION OF THE DRAWINGS

The invention description below refers to the accompanying drawings, of which.

DETAILED DESCRIPTION

Figure 1:
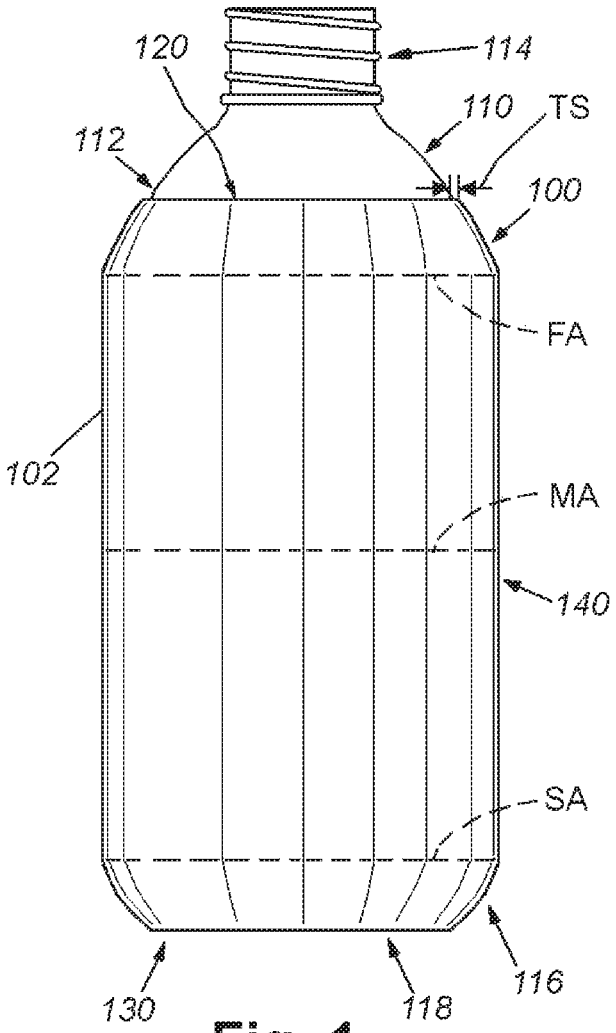
FIG. 1 is a frontal view of a bottle with a sleeve, according to a first illustrative embodiment.

FIG. 1 depicts an illustrative sleeve 100 removably attached to a bottle 110. In an embodiment, the sleeve 100 is constructed of an elastomeric polymer (for example, silicone). In an embodiment, the sleeve 100 material can be translucent and tinted with a visually pleasing color (for example, light pink or light blue). The sleeve 100 can also be adorned with patterns, logos, slogans, designs and other graphic work. The sleeve 100 can be decorative and can also be protective of the underlying bottle 110. The illustrative bottle 110 is constructed of a glass compound. In other embodiments, the bottle can be constructed of a non-glass compound. The sleeve 100 material is elastomeric and can absorb a certain amount of impact energy by compression of the material itself and by deforming its shape. The sleeve 100 is non-slippery and this enhances the consumer's grip upon the bottle and reduces the possibility that the bottle is accidently dropped.

The sleeve 100 defines a generally cylindrical shape when placed upon the bottle 110 with a first (e.g., "top") opening 120. The middle axis MA of the sleeve 100 is defined as a horizontal axis across the midpoint 140 of the sleeve, that being equidistant between the top opening 120 and a second ("base") opening 130. A first axis FA is defined as an axis that is near the top of the sleeve 100 at the point at which the shape of the bottle 110 transitions from a cylinder to a curved top portion 112, leading upwards to the neck 114. A second axis SA is defined as an axis that is near the bottom of the sleeve 100 at the point at which the shape of bottle 100 transitions from a cylinder to a curved base portion 116, leading downwards to the base 118. There is a base opening 130 at the base of the sleeve 100 that is counterpoised to the top opening. "Top" and "topmost" are each defined as a direction opposite "bottom" and "base", from the top opening 120 toward the base opening 130. "Up" and "upward" are each defined as a direction taken from the base and toward the top opening 120 with "top" being at the approximate maximum point "Down" and "downward" are each defined as a direction taken from the top opening 120 and toward the base opening 130 with "bottom" and/or "base" being at the approximate maximum point. "Interior" is defined as a region or surface facing the bottle 110 or in the open space within the sleeve 100, while "exterior" is defined as a region or surface facing away from the space of the interior and/or residing on an outside surface 102 of the sleeve and exposed to the outside environment. More generally, as used herein the directional terms, such as, but not limited to, "up" and "down", "upward" and "downward", "rearward" and "forward", "top" and "bottom", "inside" and "outer", "front" and "back", "inner" and "outer", "interior" and "exterior", "downward" and "upward", "horizontal" and "vertical" should be taken as relative conventions only, rather than absolute indications of orientation or direction with respect to a direction of the force of gravity.

The sleeve 100 has a uniform thickness TS of 1 mm when engaged with the bottle 110. The bottle 110 as shown in FIG. 1 is a bottle having an interior volume of 0.5 ml. In other embodiments, the bottle 110 can be provided with an interior volume of 1.0 ml or another size volume. A bottle system is comprised of a bottle 110 for receiving a liquid; a sleeve 100 that receives the bottle 110; and a cap 850, the cap 850 (described more fully below) is comprised of a threaded section 950 for engaging with the bottle; a reservoir chamber 900 for receiving a cosmetic 902; a barrier wall 925 disposed between the threaded section 950 and the reservoir chamber 900; a lid 804 configured to enclose the reservoir chamber 900 and to provide selective access to the cosmetic kit 800.

Figure 2:
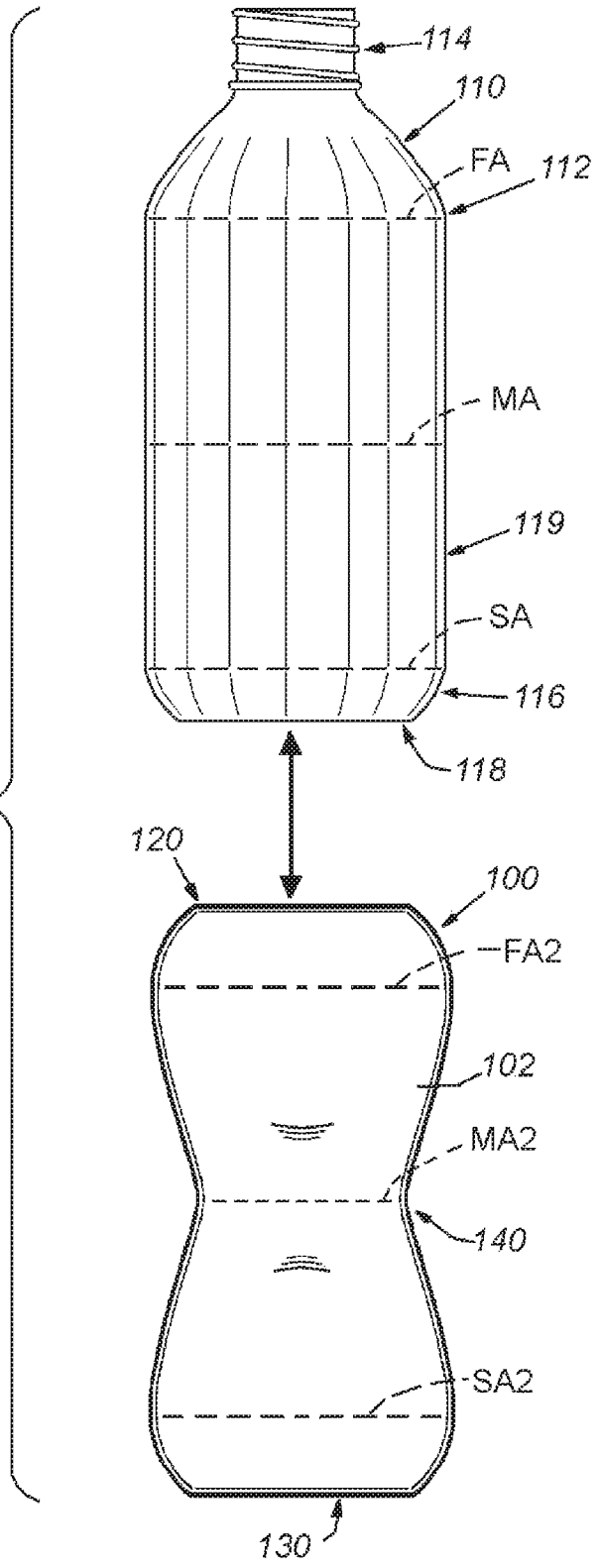
FIG. 2 is an exploded view of the bottle and the sleeve, according to the first illustrative embodiment.

FIG. 2 shows the sleeve 100 removed from the bottle 110. In this state, the sleeve and bottle can be cleaned separately. The sleeve 100 is depicted in its removed state and has a shape that is defined as an "hourglass" shape, with a diameter, circumference and cross-sectional area at the middle axis MA2 being less than a diameter of the sleeve at the first axis FA2 and openings and/or at the second axis SA2. To place the sleeve 100 over the bottle 110, the consumer places the base portion 118 of the bottle against the top opening 120 of the sleeve. The material of the sleeve 100 is elastic and can deform to stretch around the circumference of the base 118 by deformation and then passes along the curved base portion 116 to the barrel 119 of the bottle. The sleeve 100 can be manually rolled and/or unrolled, pulled, pushed or otherwise urged along the barrel 119 of the bottle until the top opening 120 passes the first axis FA and begins to retract in circumference along the curved top portion 122 until the base 118 of the bottle reaches the bottom opening 130 of the sleeve. During this engagement process, the middle axis MA2 of the sleeve deforms and the inner wall narrows (but not axis MA2) as it stretches outwardly to assume a uniform shape and thickness along the barrel 119 of the bottle 110. Removal of the sleeve 100 from the bottle 110 is followed in a reverse manner to that described above. The sleeve 100 is pliable when removed from the bottle and has a weight of about 4 ounces (113 grams). The weight of the sleeve can vary upwards or downwards, depending on the size of the sleeve and the weight of the materials.

The interior surface of the sleeve 100 is provided with a smooth texture to facilitate placing the sleeve onto the bottle and removing the sleeve from the bottle. The interior surface can include a layer of paint or other coating to enhance the removal and replacement of the sleeve. The interior surface can be machined to improve the removal and replacement. In another example, the interior surface can be textured that can engage with an exterior surface of the bottle. It is expressly contemplated that the user can exchange sleeves so that a plurality of sleeves of different designs, logos and artwork can be interchanged with one another. This interchangeability can reflect different fashions, attitudes and moods of the user. The bottle can be provided with a first sleeve that can be interchanged with a second sleeve and a multiplicity of sleeves can be provided with the bottle as part of a kit.

The "pinch" of the sleeve when not engaged with and residing on a bottle is omnidirectional and is defined as the narrowing of the sleeve at the midpoint such that the midpoint circumference and diameter of the cross-section at axis MA is less than the diameters at axes FA, SA and the openings. The diameter of the pinch is also less than the diameters of the top opening and/or the base opening. The sleeve contracts at a point equidistant from the first and second openings when removed and disengaged from the bottle.

The sleeve pinch is also a fold line across the body of the sleeve 100 and facilitates folding of the sleeve so that both end openings are in proximity to each other. This reduces the overall size and profile of the sleeve. The reduced size sleeve can be shipped more readily from the source of production and/or distribution to retailers and other distributors because the reduced size takes up a smaller volume than an unfolded sleeve and more can be placed into a shipping package, or a smaller package can be used. At the same time, the folded reduced volume saves on inventory storage. The resilient material of the sleeve unfolds without a permanent creasing and is readily placed onto a container.

Figure 3:
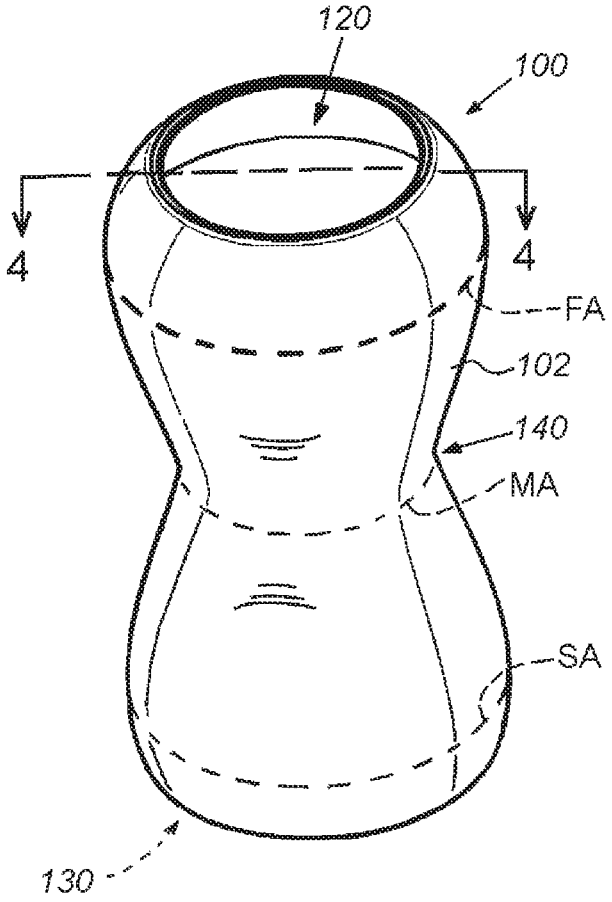
FIG. 3 is a perspective view of the sleeve, according to the first illustrative embodiment.

FIG. 3 is a perspective view of the illustrative sleeve 100 showing the top opening 120. The midpoint 140 defines a waist with a uniform (omnidirectional) pinch.

Figure 4:
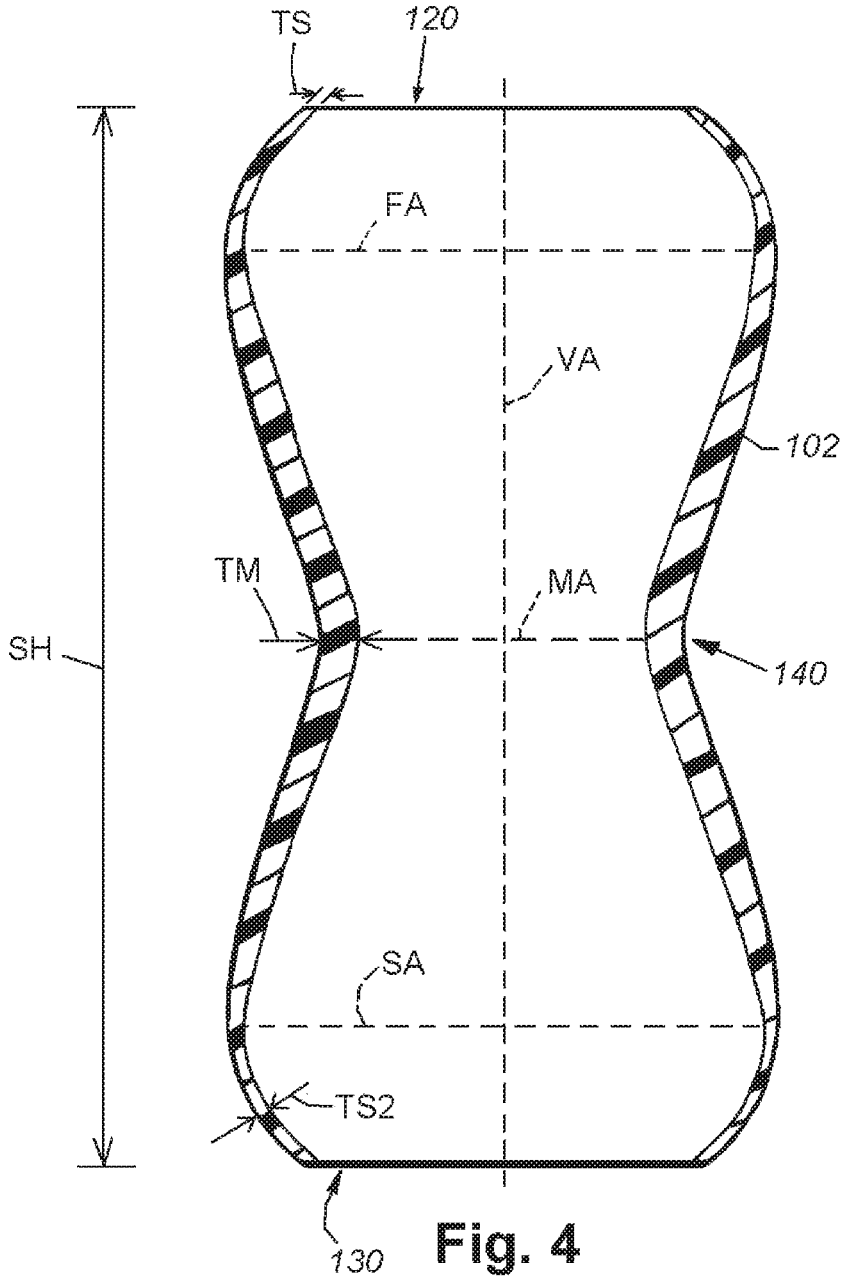
FIG. 4 is a cross-section view of the sleeve along the lines 4-4 of FIG. 3, according to the first illustrative embodiment.

FIG. 4 is a cross-section of the illustrative sleeve 100 along a vertical axis VA. The sleeve height SH is approximately 6 inches (15 cm) from the base opening 130 to the top opening 120. This height will vary depending on the size of the contained water bottle. For example, a sleeve enclosing a water bottle having a volumetric size of 1 liter has a greater height and overall size than a sleeve enclosing a bottle with a volumetric size of 0.5 liter. As stated above, the sleeve thickness TS at the top opening is approximately 1 mm. The sleeve thickness TS2 at the base opening 130 is also approximately 1 mm. The sleeve thickness tapers from its narrowest thicknesses at the top and base openings 120, 130 to a midpoint thickness TM of approximately 5 mm. The taper is uniform and omnidirectional from the relatively thin end openings to the relatively thick midpoint. When the sleeve 100 is placed onto the bottle, the sleeve stretches and the thickness at the midpoint transitions from 5 mm to 1 mm as the material uniformly stretches. In this embodiment, the stretching involves a uniform elastomeric deformation of the sleeve material. In other embodiments, the stretching can be accomplished with a vertical corrugation comprised of a plurality of vertical cuts in the material along the interior surface. The pinched waist of the sleeve 100 at the midpoint 140 is thus a thick waist that stretches outward to accommodate the enclosed bottom and contributes to a snug fit for the sleeve on the bottle.

Figure 5:
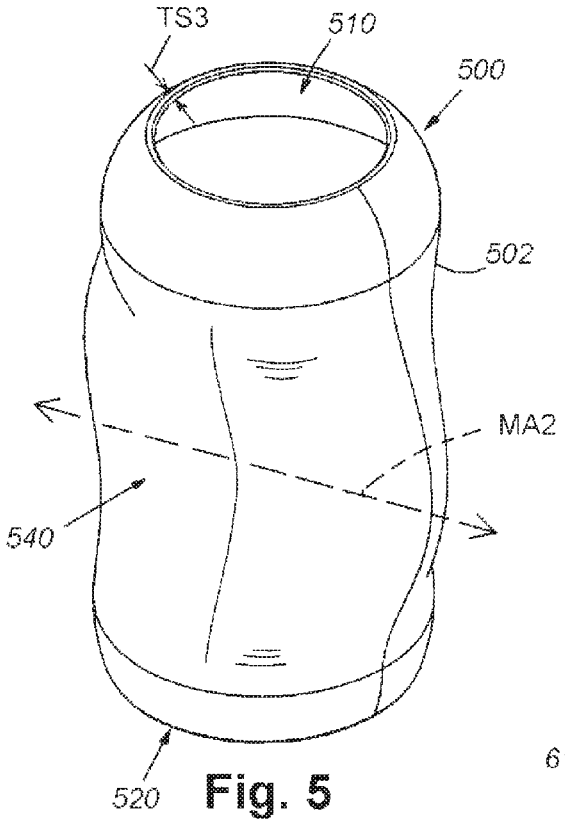
FIG. 5 is a perspective view of a sleeve, according to a second embodiment.
Figure 6:
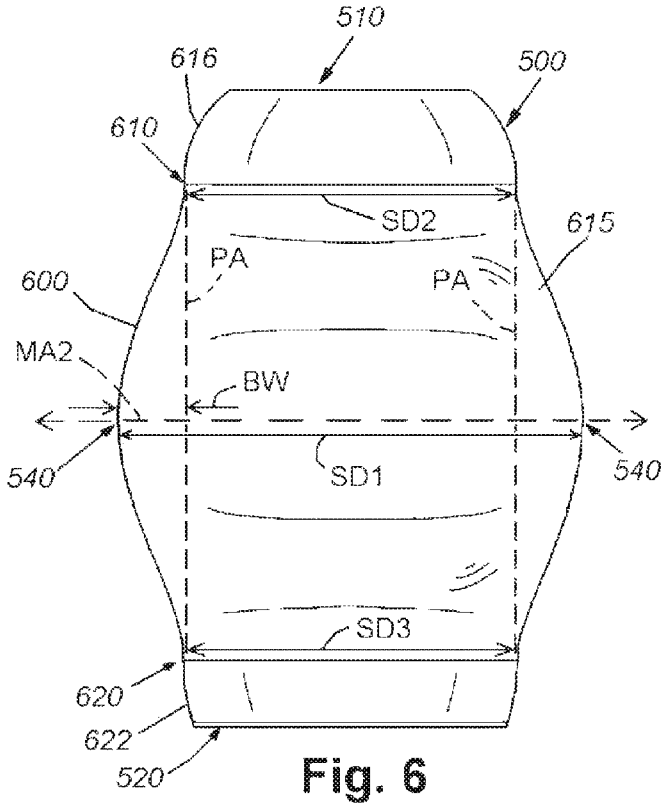
FIG. 6 is a front view of the sleeve, according to the second embodiment.
Figure 7:
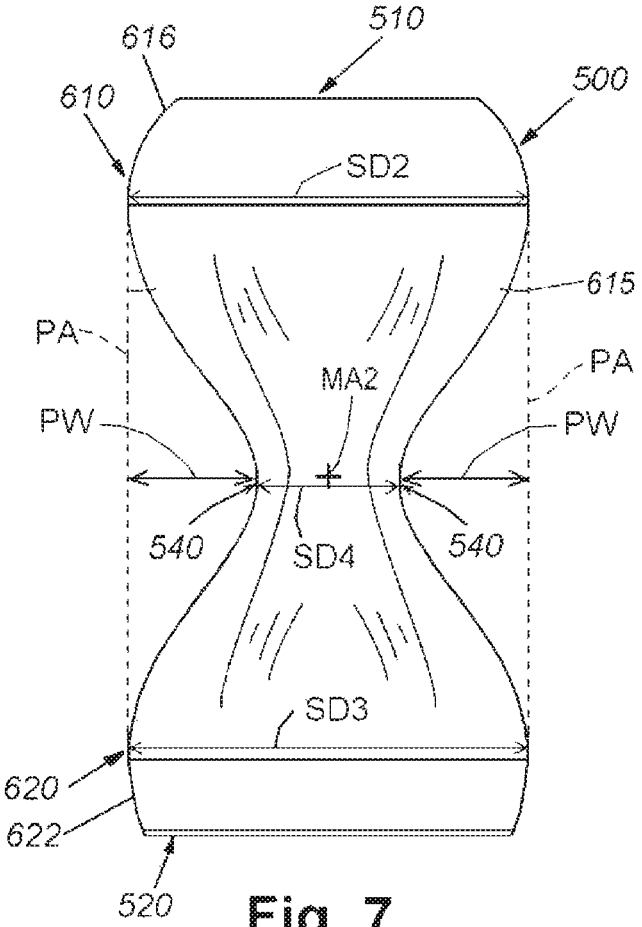
FIG. 7 is side view of the sleeve, according to the second embodiment.

FIGS. 5-7 depict an alternate embodiment of the sleeve that is defined by a pinch at the midpoint that is along an axis (e.g., "monoaxial" in orientation), in contrast to the omnidirectional pinch as set forth above. With regard to FIG. 5, a sleeve 500 is provided with a uniform thickness TS3 of approximately 1 mm along the entire body 502 of the sleeve 500. The sleeve is provided with a top opening 510 and a base opening 520. At the midpoint 540, being defined as equidistant from the top opening 510 and the base opening 520, the sleeve is pinched along a midpoint axis MA2. The midpoint axis MA2 is a horizontal axis that transects the sleeve 500. The material of the sleeve is constructed so that when the sleeve is removed from the bottle, as depicted in FIGS. 5-7, there is a noticeable pinch at the midpoint.

FIG. 6 shows the pinch at the midpoint 540 in a front view. The exterior surface 600 of the sleeve 500 bulges at the midpoint 540 along axis MA2. The perimeter axis PA is a vertical axis drawn along the outer surface of the sleeve 500 when the sleeve is engaged with and residing on a water bottle and passes from a top shoulder point 610, where the sleeve geometry when residing on a bottle transitions from a cylindrical sleeve along the middle 615 of the sleeve to a first portion 616, defined as a top shoulder segment, to a bottom shoulder 620 where the sleeve geometry when residing on a bottle transitions from a cylindrical sleeve along the middle 615 of the sleeve to a second portion 622, defined as a bottom shoulder. The bulge at the midpoint 540 has a bulge width BW of approximately 1 inch (2.5 cm). The bulge is formed along axis MA2 and is monoaxial. The diameter of the sleeve SD1 from a midpoint 540 at one end of the axis to a midpoint 540 at the opposite end along the axis is greater than at least one of the diameter SD2 at top shoulder point 610 and diameter SD3 at bottom shoulder point 620 and the diameter of the top opening and/or the base opening. The sleeve geometry transitions from a pinch to cylindrical by engagement with the exterior of the water bottle. Placing the sleeve 500 onto the bottle and removing the sleeve follows the procedure as set forth above with the exception in this embodiment, it is the shape that changes, not the thickness.

FIG. 7 is a side view of the sleeve of FIG. 5 and depicts the axis MA2 as a point. The width PW is the difference between the perimeter axis PA and the midpoint 540. Width PW is approximately 1 inch (2.5 cm). Widths BW and PW will vary depending on the volumetric size of the engaged and enclosed water bottle. The diameter of the sleeve SD4 from a midpoint 540 at one side of the axis to a midpoint 540 at the opposite side across the axis is less than at least one of the diameter SD2 at top shoulder point 610 and diameter SD3 at bottom shoulder point 620. Thus, the diameter of the sleeve 500 at the midpoint 540 is at the same time both greater and lesser than the diameters at the top shoulder point 610 and the bottom shoulder point 620.

Figure 8:
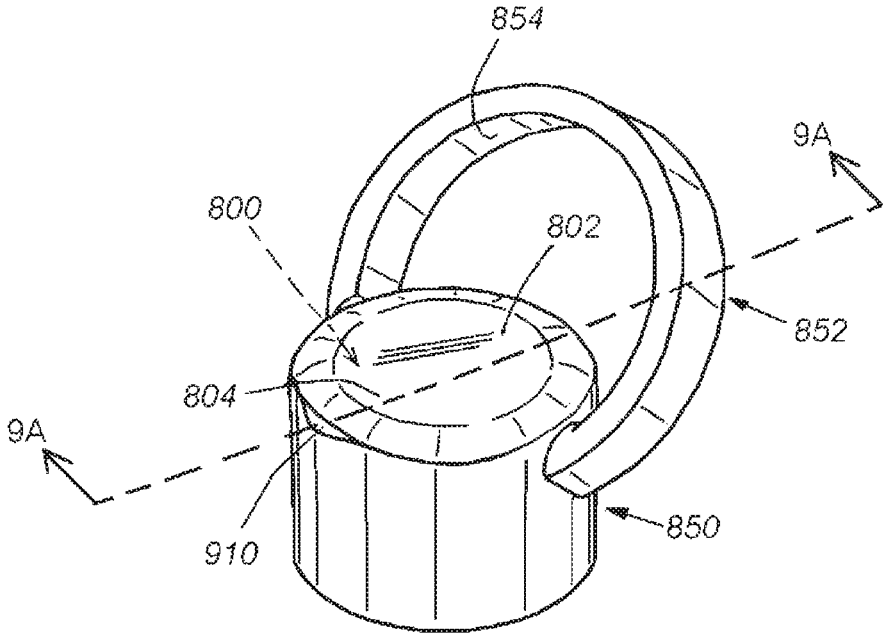
FIG. 8 is a perspective view of a closed cap with a cosmetic kit, according to an illustrative embodiment.
Figure 9:
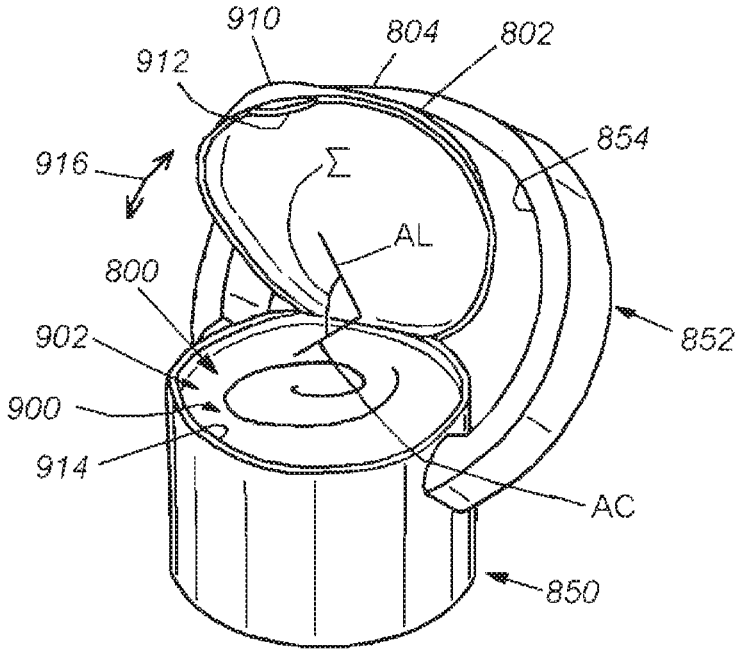
FIG. 9 is a perspective view of an open cap with a cosmetic kit, according to the illustrative embodiment.

FIG. 8 depicts a cap 850 for a bottle (a bottle as described above), with a contained cosmetic kit 800. The cap 850 can be formed of a material similar to the sleeve. The cap 850 is generally cylindrical and shown in a closed configuration in FIG. 8. In the closed configuration, the lid 804 at least partially or completely covers the cosmetic kit 800, thereby preventing access to the cosmetic kit and preventing unwanted particulates from contaminating the cosmetic kid. The cosmetic kit 800 can be comprised of one or more cosmetics. The cap is comprised of a threaded section 950 for engaging with the bottle; a reservoir chamber 900 for receiving a cosmetic 902; a barrier wall 925 disposed between the threaded section 950 and the reservoir chamber 900; a lid 804 configured to enclose the reservoir chamber 900 and to provide selective access to the cosmetic kit. FIG. 9 shows the cap an open configuration, whereby the lid 804 is unlocked and opened, thereby providing access to the cosmetic kit 800. The cap 850 can be engaged with a bottle in both the closed and open configurations as well as during use and/or refilling of the cosmetic kit. The cosmetic 902 received within the reservoir chamber 900 can be depleted and subsequently refilled. The cap with cosmetic kit can be washed along with the sleeve in a dishwashing machine or by hand.

In addition to the function of providing access to the cosmetic kit, the cap also serves to contain the contents of a water bottle and prevent materials from leaving or entering the bottle. In this regard, the cap can be threaded along a portion of the interior and an enclosed cosmetic kit is fitted above the threading and under the top surface 802 of the cap 850. The illustrative cap 850 is provided with an openable lid 804 that is hinged. In other embodiments, the lid 804 is snap fitted and held in place by tension. The cap 850 is provided with a handle 852 that can be arc-shaped and is arranged at a pre-set offset angle relative to the orientation of the cap 850. In an embodiment, the angle of the handle 852 is approximately sixty (60) degrees relative to the vertical orientation of the cap. In other embodiments, the offset angle can be greater or lesser. The interior surface 854 of the handle functions as a stop for a hinged lid 804. The lid 804 can be opened until the top surface 802 comes into contact with the inner surface 854 of the handle, as shown in FIG. 9. The lid 804, cap 850 and handle 852 are unitary in construction and are constructed of the same material. In an alternate embodiment, the top surface 802 is provided with a decorative motif, for example, a brand logo.

A method for carrying and dispensing cosmetics within a cap for a bottle is comprised of the steps of opening a lid 804 and filling a cosmetic reservoir 900 within the cap 850 with a cosmetic 902; opening the lid 804 to access and remove a portion of the cosmetic 902 from the cosmetic reservoir 900; and applying the cosmetic; and closing the lid 804. The opening of the lid 804 is stopped by contact with the handle 852.

With reference to FIG. 9, the lid 804 is opened until making contact with the handle 852 and the maximum angle Σ of opening is described as the angle between an axis AL drawn along the plane of the top surface 802 and an axis AC drawn along the plane of the top of the cap 850 and is approximately 60 degrees. When the lid is closed, angle Σ is zero degrees. In other embodiments, measurement of angle Σ when the lid is open is greater or lesser than 60 degrees. The opening of the lid provides access to a cosmetic reservoir that resides within an inner volume of the cap. The illustrative cosmetic kit 800 is provided with a single cosmetic reservoir 900 that can contain at least one cosmetic 902 (for example, a lip gloss product). As used herein, the content of the cosmetic reservoir can include, but is not limited to lip gloss, lip balm, hair gel, cover up, base foundations, blush, eye shadow, sun screen, pills, and the like. The lid 804 is held in a closed orientation by tension from a locking lip 912 against the inner perimeter 914 of the cap and is released by the user placing a fingernail or digit against a tongue 910 that is part of the lid and exerting pressure to pop the lid open, causing a release of the locking lip 912 and free movement 916 of the lid. When the lid is open, the user can dispense a portion of the cosmetic with a finger or an applicator and apply the cosmetic to his or her person. The closing of the lid creates an annular seal to contain the enclosed cosmetics. When a sufficient amount of cosmetic has been removed, the user closes the lid by pressing it downward until the locking lip engages the inner perimeter 914 and snaps in a closed configuration. The illustrative cosmetic reservoir 900 is formed as part of the cap 850 and is refillable by the user. It is expressly contemplated that the bottle with cap can be provided with an existing cosmetic already residing in the reservoir 900 and a supply of pre-measured cosmetic refills as part of a kit.

Figure 9A:
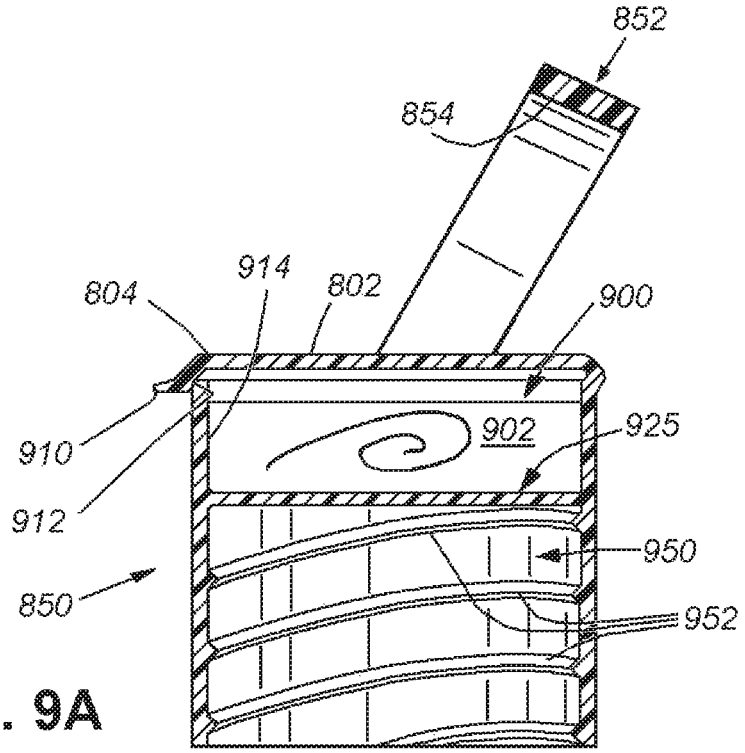
FIG. 9A is a cross-section view of a cap with a cosmetic kit along lines 8-8 of FIG. 8, according to the illustrative embodiment.

FIG. 9A is a cross section view of the cap showing the cap 850 with a threaded cap interior 950, a cosmetic reservoir 900 and a barrier wall 925 therebetween that divides the cosmetic reservoir and the cap interior. The cap interior 950 is provided with threading 952 that is compatible with the threading on the bottle (not shown). In an embodiment, the cosmetic 902 is placed directly into the reservoir 900. In another embodiment, the cosmetic 900 is provided in a refillable open-topped tray that is sized to be placed within the reservoir 900.

Figure 10:
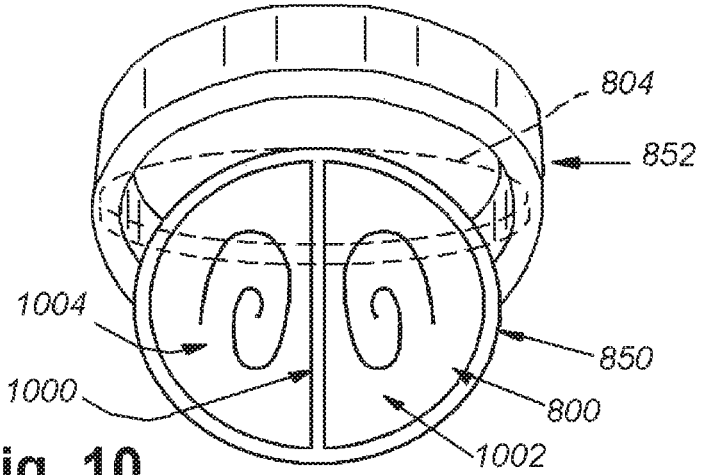
FIG. 10 is a top view of a cap with a cosmetic kit that includes two cosmetic reservoirs, according to an illustrative embodiment.

FIG. 10 shows a cosmetic kit 800 that is constructed with a central septum, or dividing wall 1000 so that there are two cosmetic reservoirs 1002, 1004. The lid 804 is shown in broken lines so that the septum 1000 is clearly seen. The cosmetic reservoirs 1002, 1004 are shown as hemispherical shape of equal size. Both reservoirs are formed in the top of the cap and are non-removable. In other embodiments, the reservoirs can be of unequal sizes and removable as cups. It is further contemplated that the septum can be a circular wall, so that there are concentric nestled reservoirs, with one outside of the other. It is contemplated that the cosmetic reservoirs 1002, 1004 can retain two discrete cosmetics, for example, a foundation base in one and a lip gloss in the other.

Figure 11:
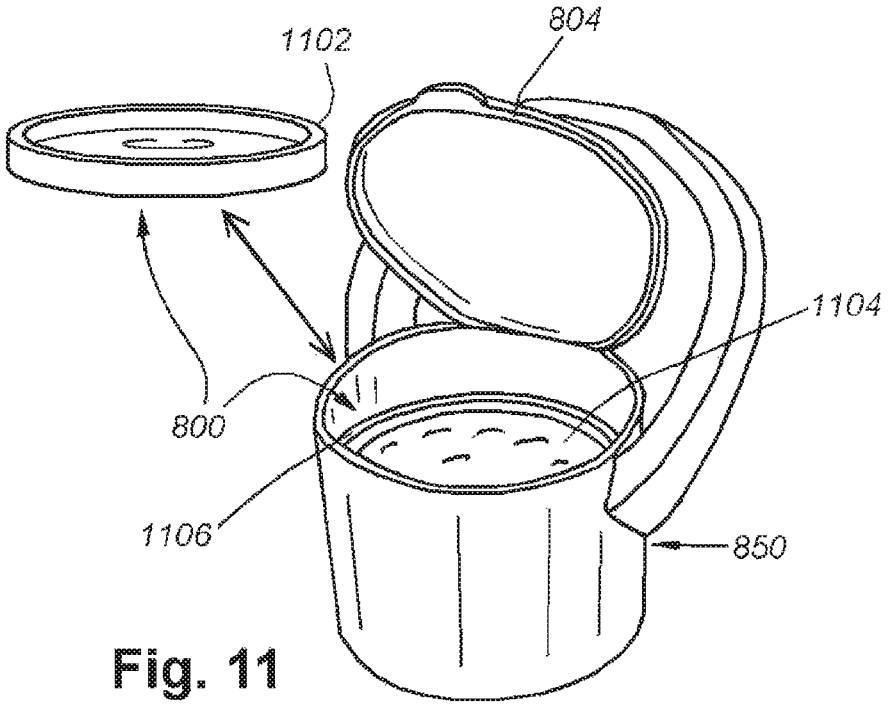
FIG. 11 is a perspective view of a cosmetic kit with stacked cosmetic reservoirs, according to an illustrative embodiment.

FIG. 11 depicts a cosmetic kit 800 with two cosmetic reservoirs 1102, 1104 that are stacked one upon the other. Reservoir 1102 is a removable tray that can be withdrawn from the cap to provide access to reservoir 1104. Reservoir 1104 is formed as part of the cap 850. Reservoir 1104 is provided with a circumferential lip 1106 to support reservoir 1102 when stacked. It is contemplated that reservoir 1102 is fitted into the cap with a snug fit to prevent it from rattling within the cap during movement.

Figure 12:
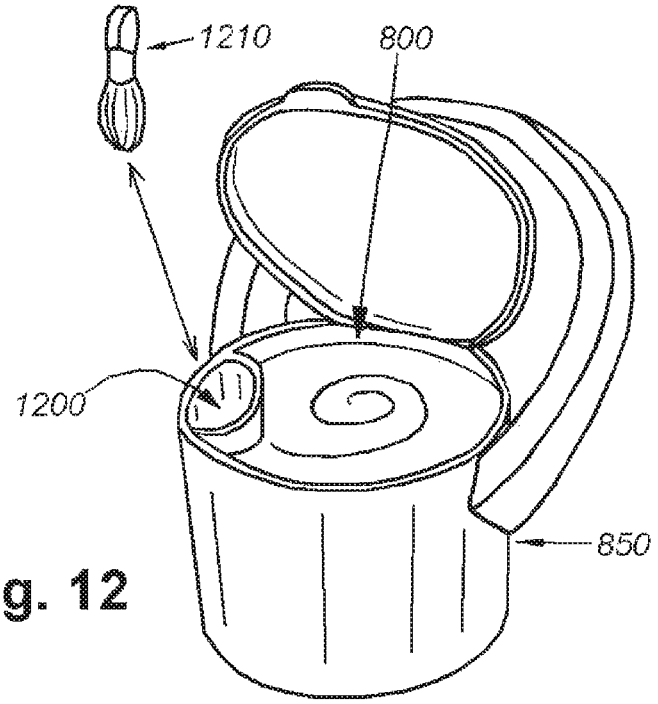
FIG. 12 is a perspective view of a cosmetic kit with an applicator, according to an illustrative embodiment.

FIG. 12 shows a cap 850 with a single reservoir 800 that is constructed with a well 1200 for carrying an applicator 1210. The applicator 1210 can be a small brush, a sponge or another applicator. The applicator well 1200 can include a simple spring loaded device to ease removal of the applicator 1210 when in use, or to hold the applicator under tension and abate rattles while in movement. Reference is now made to FIGS. 13-30, which show and describe a further embodiment of a cosmetic cap in which the container storing the cosmetic (or other compound) is removable and replaceable with respect to the underlying cap structure. A cap 1300 for a bottle comprises a base for engaging a top of the bottle and a cavity for receiving a removable tray adapted for containing a dispensable material for use by a user. The cap is comprised of a removable compact 1310 that can include a removable tray 1312 adapted for containing a dispensable material for use by a user and a lid 1314. The tray 1312 includes a sidewall, a rear attachment region that includes at least one detent or notch, and a front engagement region that includes at least one tooth extending distally outward from a lower region of the sidewall, as will be more fully described below. The tray 1312 can be filled with a cosmetic, at least one small item, or other materials or items. The lid 1314 can be attached to the tray 1312 by an integral hinge 1316. The lid 1314 can move freely on the hinge 1316 between a closed position and an open position with respect to the tray 1312. A handle extending from the cap is positioned to form a stop to the lid 1314 in an open position. The hinge is free of springs. The lid 1314 can be secured by a snap fit into a closed position, and can be held in place by a catch 1318 on the tray 1312. The snap fit thus created is free of non-unitary components. In an open position, the lid 1314 can rest against the handle 1320. The lid is hingedly attached to the tray by a hinge, whereby the lid moves selectively between a closed position and an open position; and an interengaging retaining structure that removably secures the tray in the cavity (described more fully below).

Figure 14:
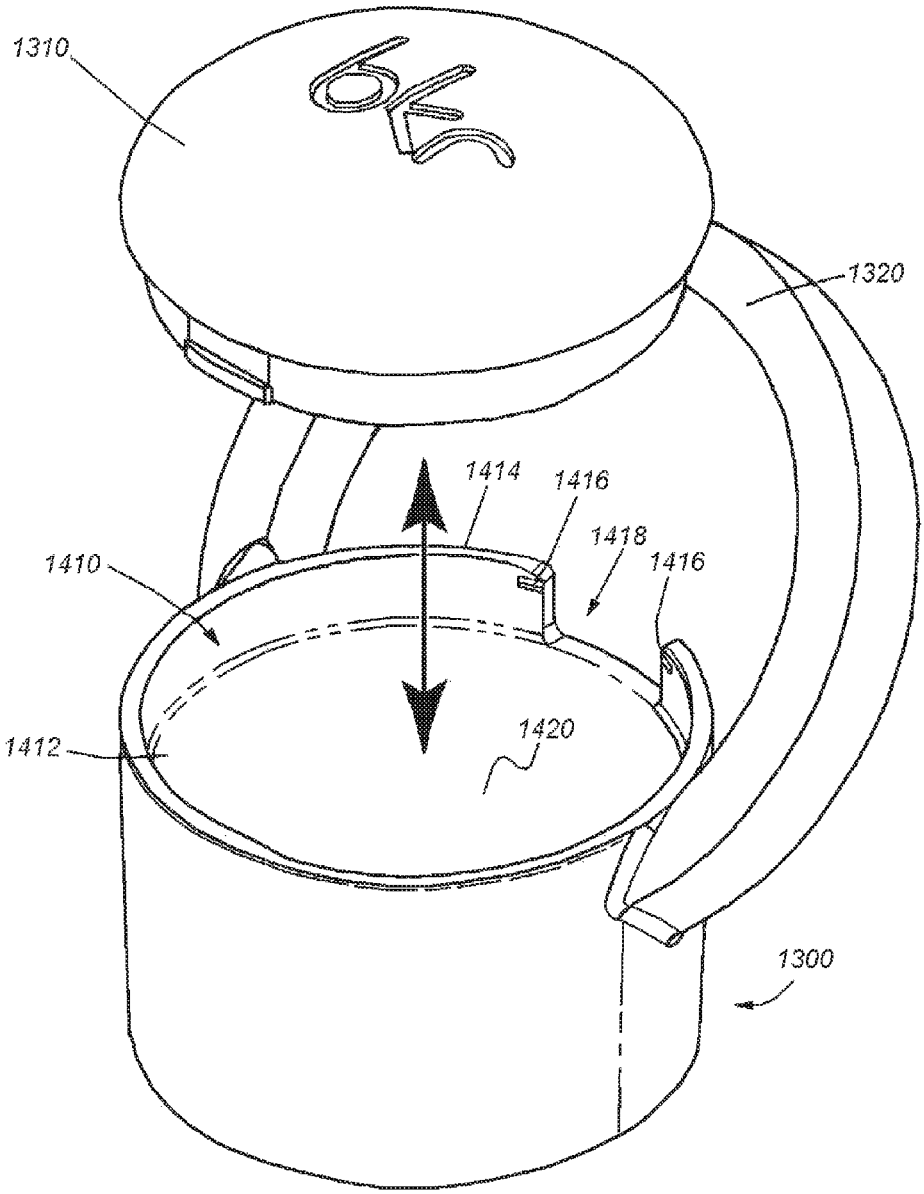
FIG. 14 is a perspective view of a cap with a removable compact separated from the cap.

FIG. 14 shows the compact 1310 removed from the cap 1300. The cap 1300 includes a cavity 1410 adapted to contain the compact 1310. The cavity 1410 is defined by a floor 1412 and a rim 1414. In an embodiment, the floor 1412 is the top surface of the barrier wall 1420. The rim 1414 extends upwards from the floor 1412 as a wall (as shown), or in alternate embodiments can be posts, bands, or other structures adapted to contain the compact 1310 by preventing lateral movement of the compact 1310 on the floor 1412. The rim 1414 includes notches 1416 adapted to be engaged by detents (described more fully below) on the tray 1310. The rim 1414 can include a gap 1418. The gap 1418 can be a break in the rim 1414 adapted to house a hinge 1316 and allow a user access to the hinge 1316 or another portion of the compact 1310 through the gap 1418. The surface defining the cavity further defines a gap in the cavity for the hinge, thereby setting the rotational position of the tray within the cavity.

In operation, a user can remove and replace a compact 1310 when a cosmetic (not shown) in the compact 1310 is depleted, when a user wishes to switch to a different cosmetic in a different compact 1310, or when a user wishes to carry different materials or items in a compact 1310. In operation, a compact 1310 can be sold pre-filled with a cosmetic or other materials, or can be sold empty for a user to add cosmetics or other materials or items.

Figure 15:
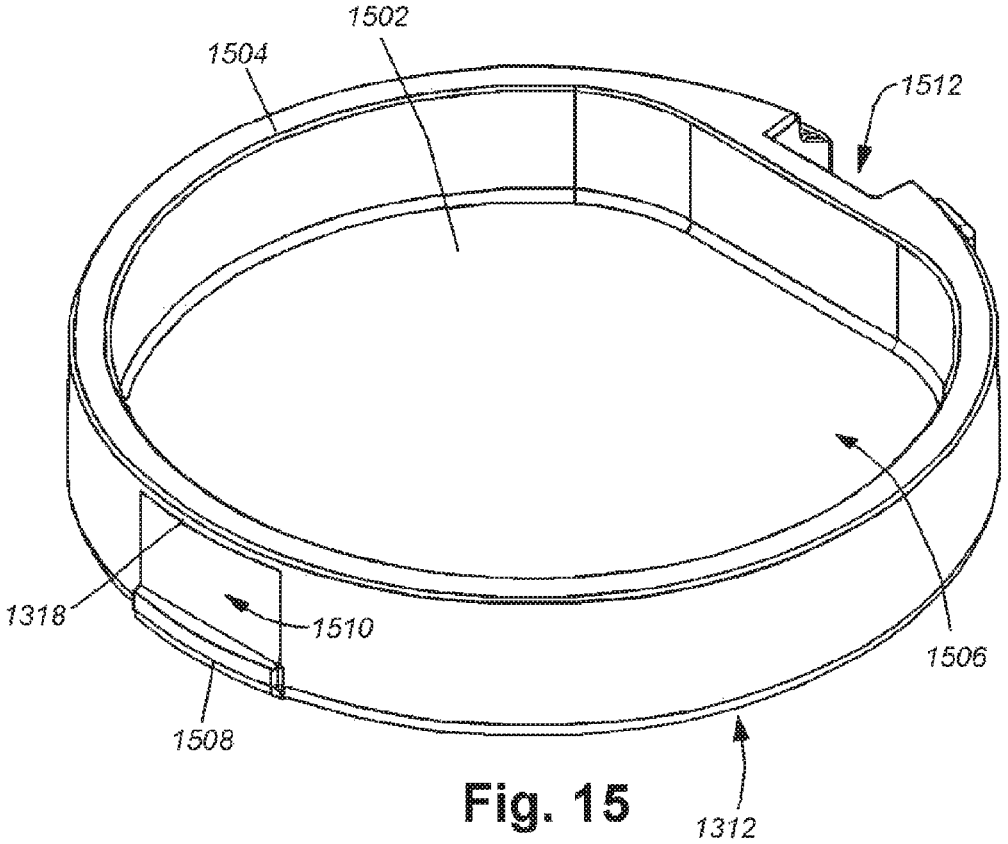
FIG. 15 is a perspective view of an embodiment of an isolated compact tray showing front engagement systems.

FIG. 15 is an embodiment of a tray 1312 with front engagement systems. The tray 1312 can comprise a bottom plate 1502 and a sidewall 1504 extending upwards from the plate 1502 forming a bowl 1506 adapted to contain a cosmetic or other material or items. The tray 1312 can further comprise a tooth 1508 and a catch 1318. The tray 1312, the tooth 1508, and the catch 1318 can be of unitary construction. The tray 1312 is replaceable. Catch 1318, as described above, is adapted to hold the lid 1314 in a closed position. Tooth 1508 can extend from the tray 1312 and can be adapted to engage a corresponding groove within the cap 1300 for securing the compact 1310 to the cap 1300. Replacement trays can comprise the tooth adapted for securing the tray to the cap. The tray 1312 is provided with an indent 1510 below the catch 1318. The sidewall 1504 includes a furrow 1512 at a rearward portion of the tray 1312 adapted for housing a hinge leaf (described more fully below). "Front" is defined herein as the region facing the user while the compact 1310 is installed on the cap 1300 and the user is accessing the cosmetic (not shown); conversely, the "rear" is defined as the region facing away from the user. The compact 1310 is a compact kit that includes a tray having a bottom plate and a sidewall; a lid; an integral hinge, wherein the hinge defines a rear portion of the kit; and a tooth extending from a front portion of the kit and adapted to engage within a rabbet in the cap for securing the kit to the cap. The compact kit is replaceable, and replacement kits are adapted to be secured within the cap. The compact kit is similar to the lid structure as described above, comprising a hinge leaf and a loop within the hinge leaf with the tray further comprising a hinge anchor and the hinge including a lid, tray and a hinge pin. The hinge is adapted to be housed within a gap in the cap, thereby setting the rotational position of the tray within the cap. Likewise, the tray includes at least one detent extending from the rear portion of the kit and adapted to engage within at least one corresponding notch in the cap for securing the kit to the cap and the lid is secured to the tray in the closed position by a snap fit free of non-unitary components.

Figure 15A:
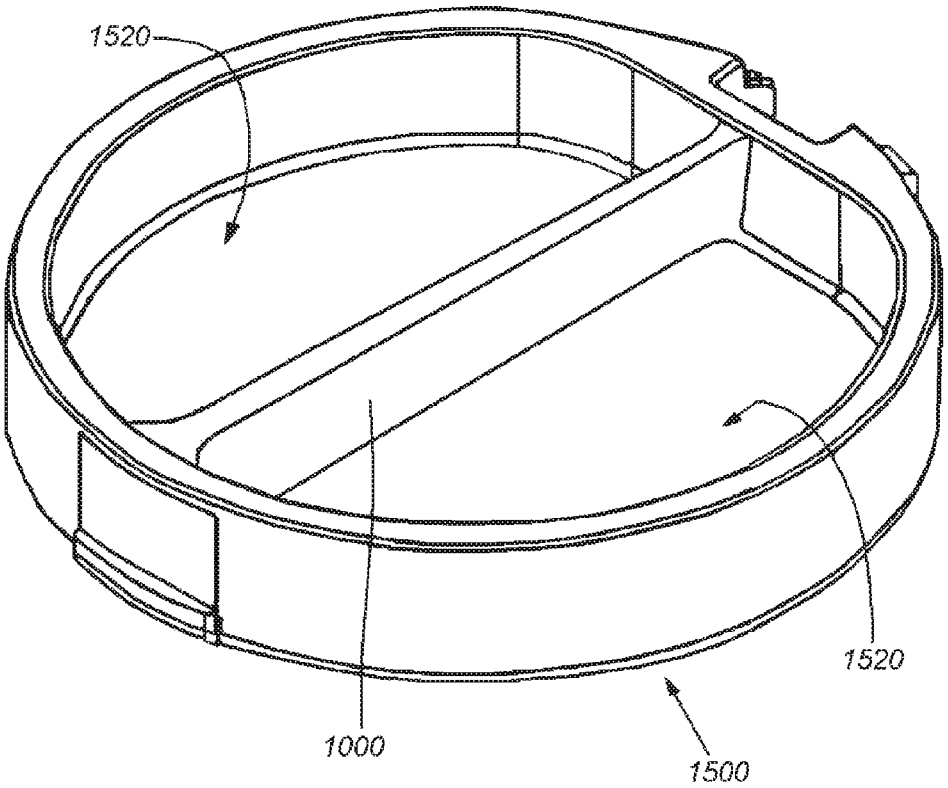
FIG. 15A is a perspective view of an alternate embodiment of an isolated compact tray.

FIG. 15A shows an alternate embodiment of a tray 1500 that is constructed with a central septum 1000 dividing the tray 1500 into at least two separate bowls 1520. While the septum 1000 is depicted as linear, other configurations are expressly contemplated, including a Y-shaped septum, X-shaped septum, arc-shapes, concentric circles, or multiple septa dividing the tray 1500 into a plurality of bowls 1520 or compartments. It is contemplated that the at least two bowls 1520 can be adapted to contain different materials or items.

Figure 13:
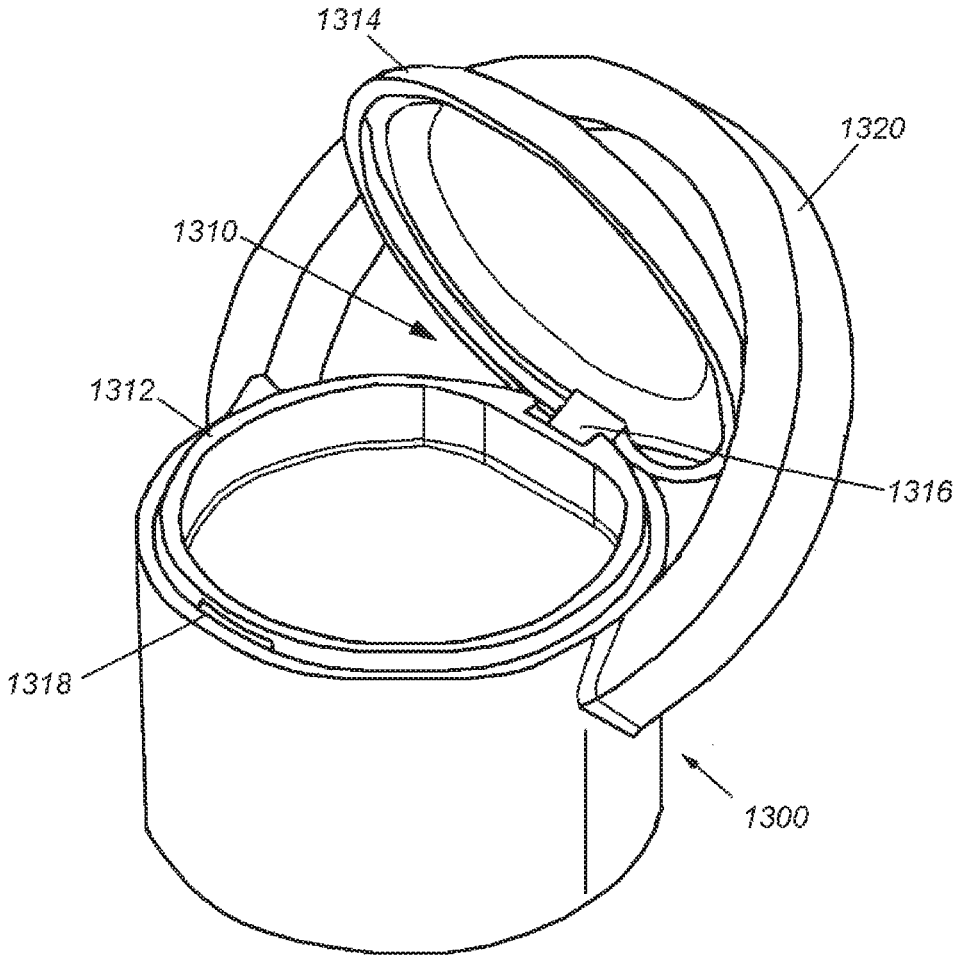
FIG. 13 is a perspective view of a cap with a removable, replaceable compact installed.
Figure 16:
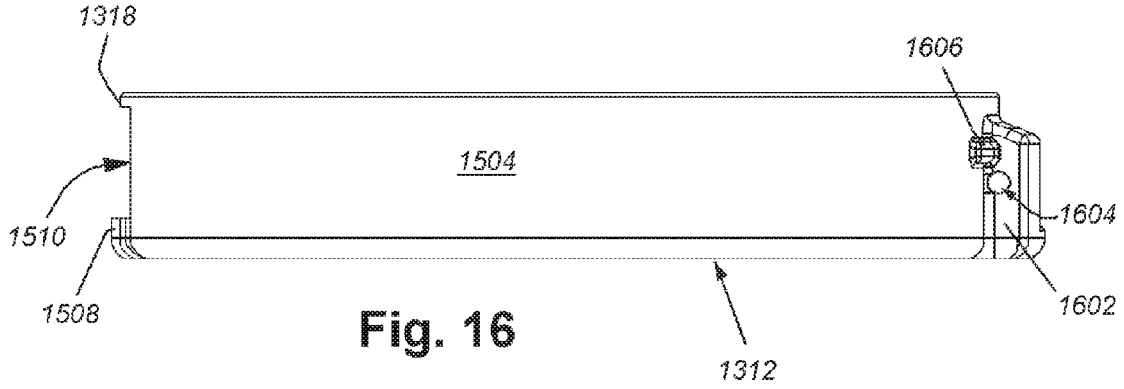
FIG. 16 is a side view of an embodiment of an isolated compact tray showing front and rear engagement systems.

FIG. 16 depicts a side-view of the tray 1312 of FIG. 13 showing the unitary catch 1318, the indent 1510, and the unitary tooth 1508. The tray 1312 can further comprise a unitary hinge anchor 1602 that can be located at a rearward portion of the tray 1312. The hinge 1316 is an assembly that is comprised of the hinge anchor 1602, the lid 1310, a hinge leaf 1810, a hinge pin 1902 and a loop/through-hole 1814 within the hinge leaf. The hinge anchor 1602 can include a through-hole or a knuckle 1604 through the hinge anchor 1602 adapted to house a hinge pin (described more fully below), so that the lid can be hingedly attached to the tray 1312 by the hinge pin, allowing the lid to be moved between an open position and a closed position with respect to the lid. The tray 1312 can further comprise a unitary detent 1606. A detent 1606 can be a nodule raised outwards from the tray 1312 and adapted to engage a notch 1416 in the rim 1414 of cap 1300 (not shown) for securing the tray 1312 to the cap. A detent 1606 can protrude from the sidewall 1504 or the anchor 1610.

Figure 17:
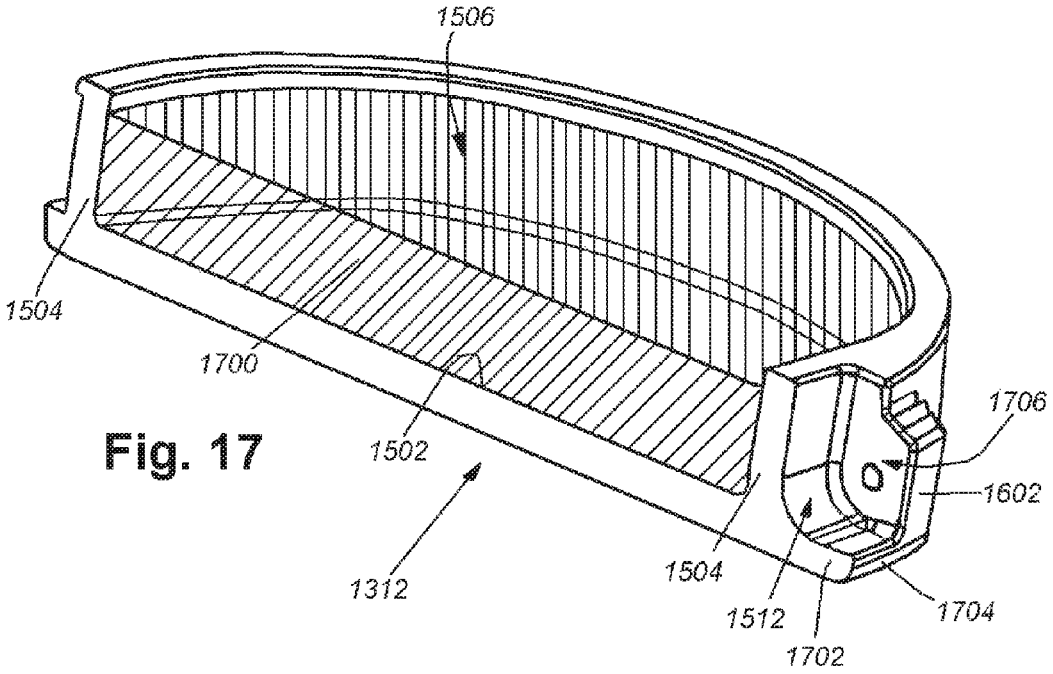
FIG. 17 is a cross section of an isolated compact tray filled with makeup and showing the hinge area of the tray.

FIG. 17 shows a cross section of the tray 1312 depicted as containing a cosmetic 1700 within the bowl 1506. In the alternative, it is expressly contemplated that the bowl 1506 can be filled with lip balm, sunscreen, adhesive, lubricant, pills, jewelry, small items, or any other substance or item a user may wish to have nearby. In an embodiment, the tray 1312 can be further comprised of a unitary tab 1702 adapted to extend distally outwards from the tray 1312 into the gap 1418 in the rim 1414 of the cap (not shown). The tab 1702 can be adapted so that in operation, a user applies force on the tray 1312 via the tab 1702 in an upward or inward direction, thereby disengaging the detents 1606 from the notches 1416 in the cap 1300 (not shown) and releasing the tray 1312 from the cap 1300. The tab 1702 can have at least one raised ridge or tread 1704 on a distal surface of the tab 1702 for a user's finger or thumb to grip the tab 1702 in operation and apply a force on the tray 1312 to release the tray 1312 from the cap 1300. Tray 1312 can include a hinge channel 1706 adapted for housing a hinge leaf (described more fully below). Channel 1706 is defined by the sidewall 1504, the furrow 1512, the tab 1702, and/or the anchors 1602.

Figure 18:
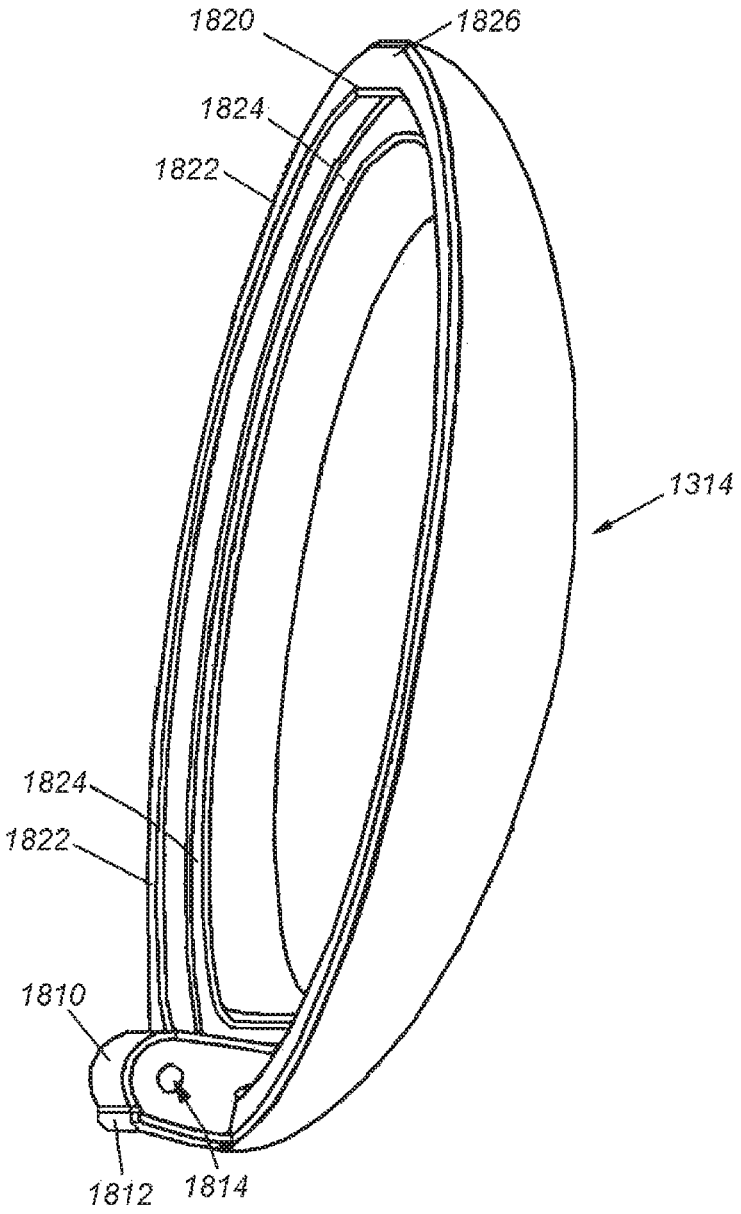
FIG. 18 is a perspective view of an isolated compact lid showing the hinge portion of lid and snap-fit engaging portion of lid.
Figure 19:
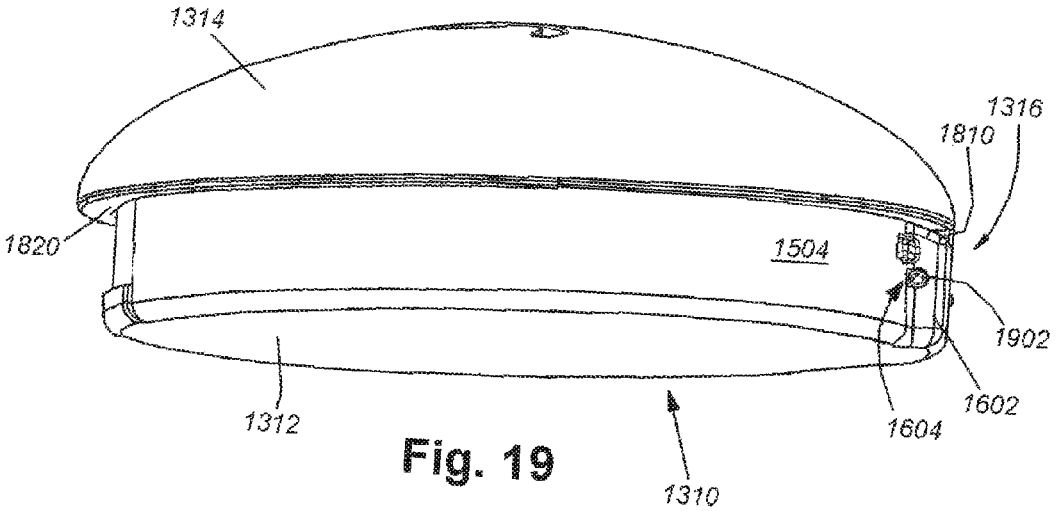
FIG. 19 is a perspective view of a tray and a lid assembled to form a compact showing a snap-fitted closed lid.
Figure 20:
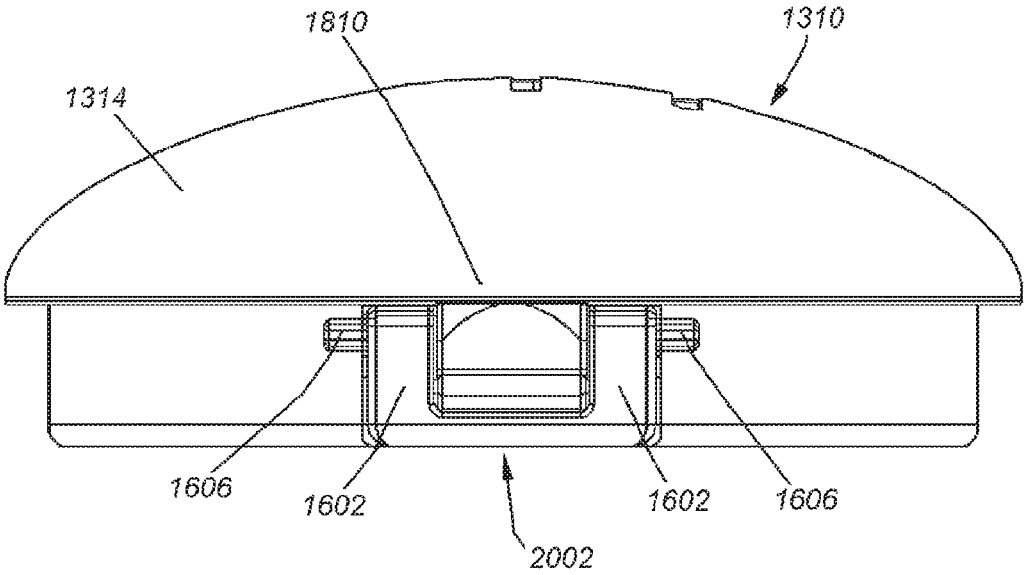
FIG. 20 is a rear view of an assembled compact showing the hinge and rear engagement system.

FIG. 18 shows the lid 1314 with a unitary hinge leaf 1810. According to the illustrative embodiment, the hinge leaf 1810 can include at least one unitary rib 1812 or other raised surface on a rearward portion of the hinge leaf 1810, allowing a user's finger or thumb to grip the compact 1310 and apply force to the compact 1310 in an inward or upward direction, thereby disengaging the detents 1606 from the notches 1416 and releasing the compact 1310 from the cap. The hinge leaf 1810 can include a through-hole or loop 1814 in the hinge leaf 1810 adapted to house a hinge pin (described more fully below), so that lid 1314 can be hingedly attached to the tray 1312 by the hinge pin, allowing the lid to be moved between an open position and a closed position with respect to the lid. The lid 1314 can be held in a closed position by tension from a unitary locking lip 1820 on the lid 1314 against a catch 1318 on the tray 1312, thereby securing the lid 1314 closed with a snap-fit that is free of springs or other non-unitary components. The lid 1314 can have a lower surface forming an overhang 1822 adapted to hang parallel to and below the top surface of the sidewall 1504 of the tray 1312 when the lid 1314 is in a closed position. Lid 1314 can have an inner surface or seat 1824 adapted to meet the top surface of the sidewall 1504 of the tray 1312 when the lid 1314 is in a closed position. Seat 1824 can be adapted to form an annular seal with the top surface of the sidewall 1504 when the lid 1314 is closed against the tray 1312. The seat 1824 and/or the top of the sidewall can include a resilient material to create a watertight seal, or other mechanism adapted to forming an annular seal such as a tongue and groove. As shown in FIGS. 19 and 20, the overhang 1822 can extend radially beyond the tray 1312. With reference to FIGS. 18 and 19, in operation a user can apply pressure against a tongue 1826 that is part of the lid 1314 to cause a release of the lip 1820 and pop the lid open, allowing movement of the lid 1314 between a closed position and an open position.

Note that the snap fitments described herein (using a retaining structure, etc.) are generally accomplished by a first shoulder, shelf, projection or protrusion that springingly passes over an interengaging second shoulder, protrusion, lip or other (e.g. radial) projection in an opposing direction from the first shoulder, shelf projection or protrusion (also termed first projection and second projection). This spring force is typically provided by hoop stress or a leaf spring arrangement—for example where cuts are provided on one or both sides of either (or both) projection(s), thereby defining a unitary leaf spring. The interengagement between the first and second projections can be overcome by moderate force that causes at least one of the projections to spring out of interference with the other projection. The projections can include appropriate bevels, bullnoses or other ramp-like surfaces that facilitate fitment together or removal from each other—allowing one projection to pass over the other and spring appropriately.

FIG. 19 shows a side view of assembled compact 1310, including the tray 1312 and the lid 1314, with the lid 1314 depicted in a closed position. The lid 1314 is hingedly attached to the tray 1312 at a rearward portion of the compact 1310 by a hinge pin 1902 that extends through the hinge anchor 1602 at the knuckle 1604 and through the hinge leaf 1810 of the lid 1314 forming an integral hinge 1316. The lip 1820 is shown engulfing the catch (not shown) so that the snap-fit is engaged to hold the lid 1314 in the closed position. The bottom of the tray 1312 is shown with a flat sole 1904. In other embodiments, the sole 1904 can have depressions, raised points, one or more ridges, or other features designed to mate with corresponding depressions, raised points, or ridges in the cavity of the cap.

FIG. 20 shows a rear view of the compact 1310 with the lid 1314 in a closed position. The compact 1310 includes two detents 1606 and the lid 1314 hingedly attached to the tray 1312 by the hinge pin 1902 extending through the anchors 1602 and the leaf 1810. The hinge 1316 is comprised of the anchors 1602, the leaf 1810, the pin 1902, the tab 1702, and/or the channel 1706. The overhang 1822 is shown extending outward and over the sidewall 1504. The compact 1310 can include a rearward area, or key 2002, that can be accessible through the gap 1418 and can include the hinge 1316. In operation, a user releases the compact 1310 from the cap 1300 by applying force to the compact 1310 at the key 2002 through the gap 1418 in an inward and upward direction to release the detents 1606 from the corresponding notches in the rim of the cap, pushing the compact 1310 up and out of the cap.

Figure 21:
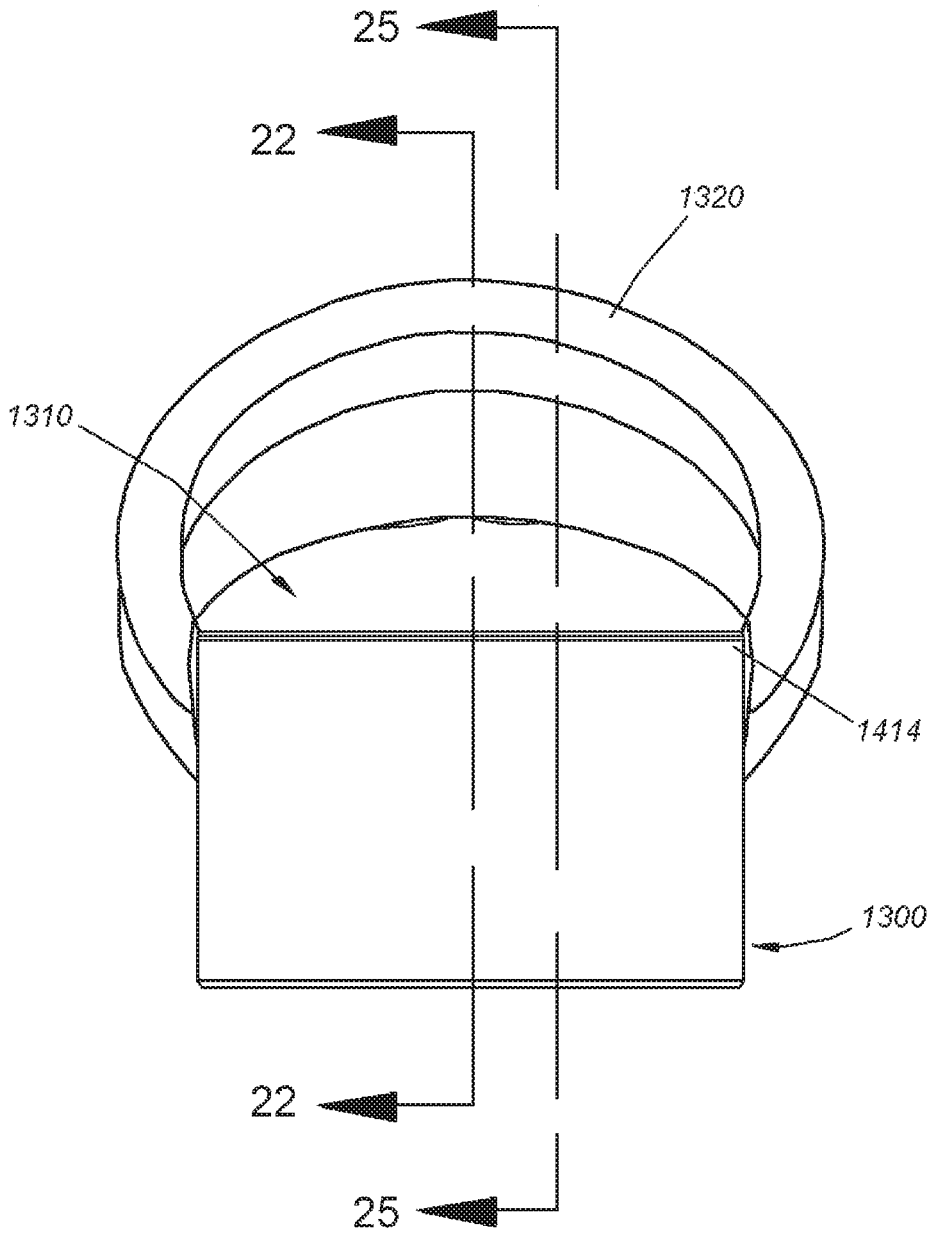
FIG. 21 is a front view of a cap with an installed compact showing cross section lines.

FIG. 21 is a front view of the cap 1300 with an installed compact 1310 showing cross-section lines 22-22 and 25-25. The outer circumference of the lid 1314 can be approximately similar to the outer circumference of the rim 1414 so that the overhang of the lid 1314 substantially lines up with and can appear to meet the top of the rim 1414.

Figure 22:
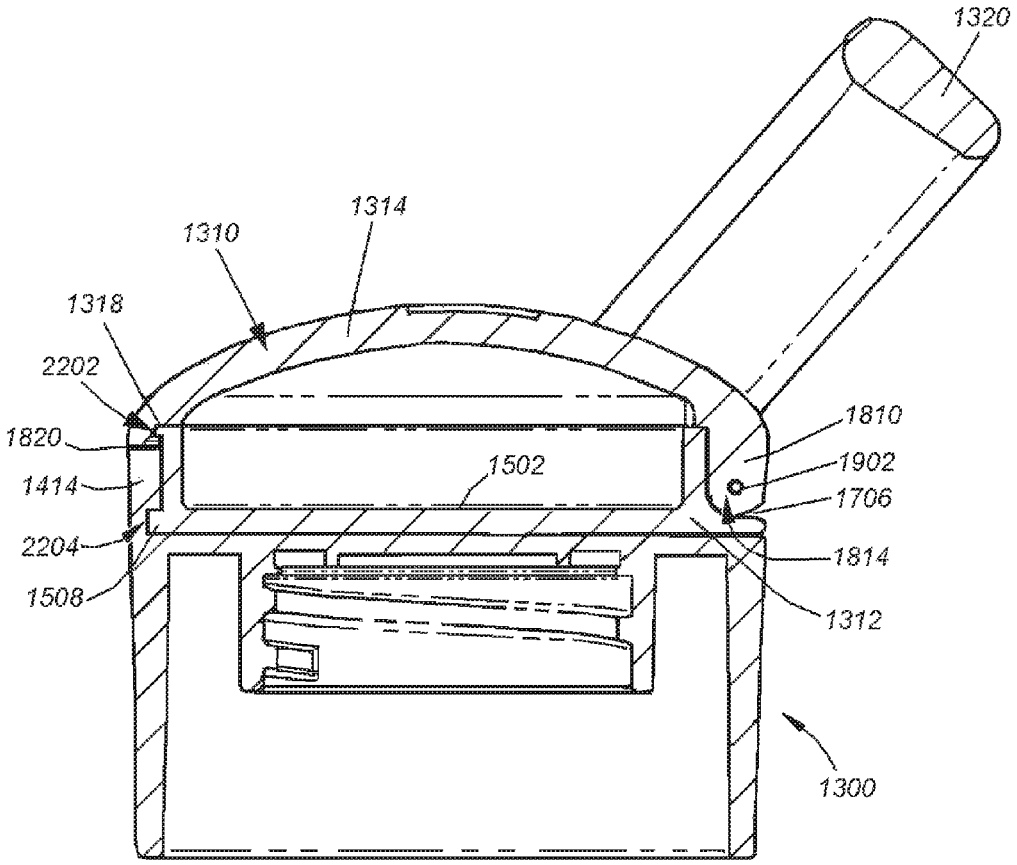
FIG. 22 is a cross sectional view of a cap with installed compact showing front engagement systems.

FIG. 22 shows a cross section of the cap 1300 with an installed compact 1310 at cross-section line 22-22. Leaf 1810 can be housed in the hinge channel 1706. The pin 1902 is housed in the leaf 1810 at the loop 1814, and can hingedly attach the lid 1314 to the tray 1312. The lid 1314 is held in a closed position by a snap fit comprising the catch 1318 held in a groove 2202 formed in the lid 1314 by the lip 1820. Tray 1312 is secured to the cap 1300 with the tooth 1508 of the tray 1312 engaged in a rabbet 2204 formed within the inner surface of the rim 1414 of the cap 1300 and creating an interengaging retaining structure that comprises a tooth extending from the tray and adapted to engage within the rabbet, whereby the tooth and the rabbet are adapted for securing the tray to the cap.

Figure 23:
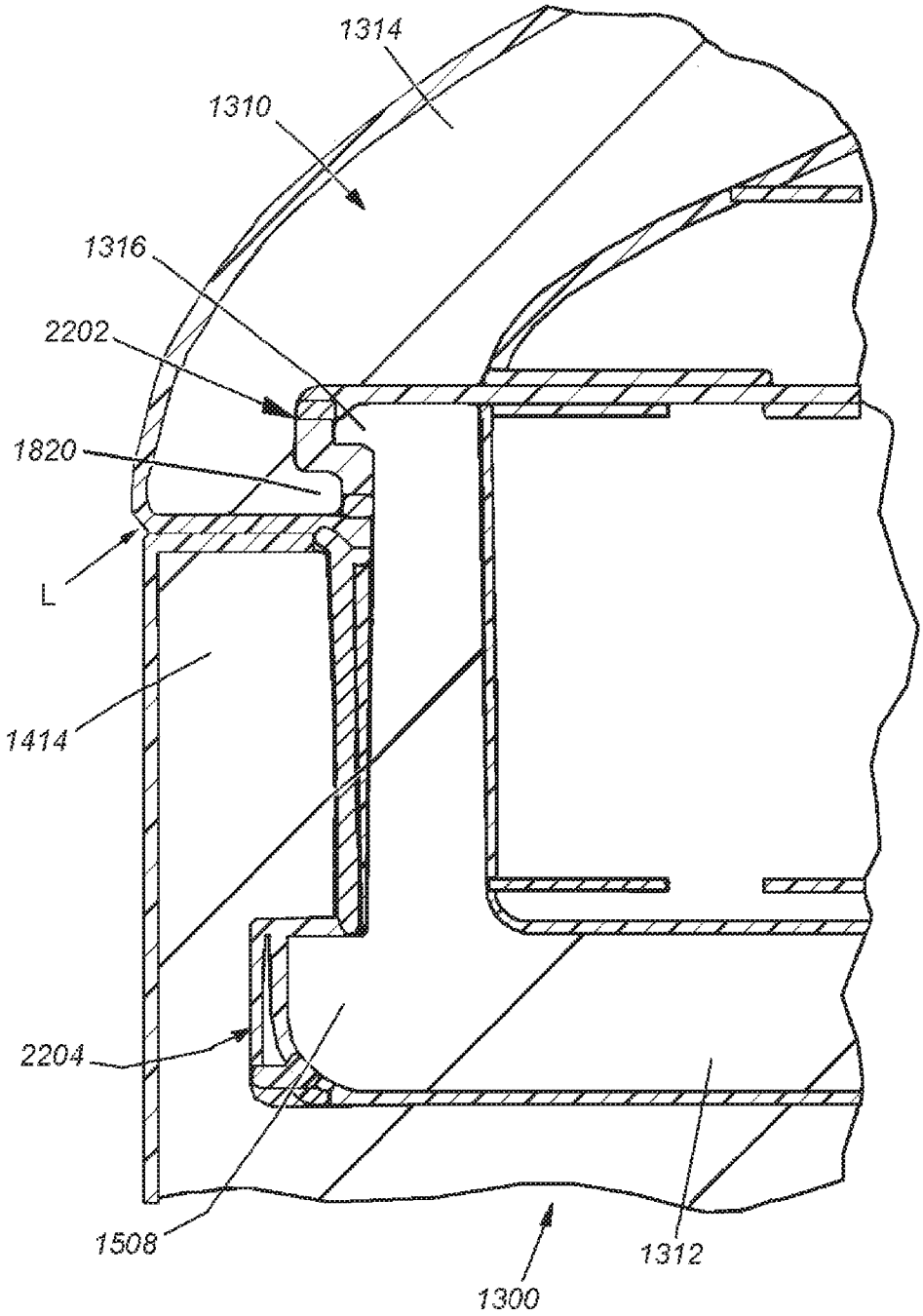
FIG. 23 is an enlarged view of front engagement systems from FIG. 22 showing force vector used to open snap-fit lid.

FIG. 23 shows an enlarged view of the engagement systems depicted in FIG. 22 and described above. In operation, a user can apply force to the tongue 1826 along force vector L to disengage the catch 1318 from the groove 2202 causing a release of the snap fit and allowing a user to access the contents of the compact 1310 by rotating the lid 1314 about the hinge pin 1902 and into an open position.

Figure 24:
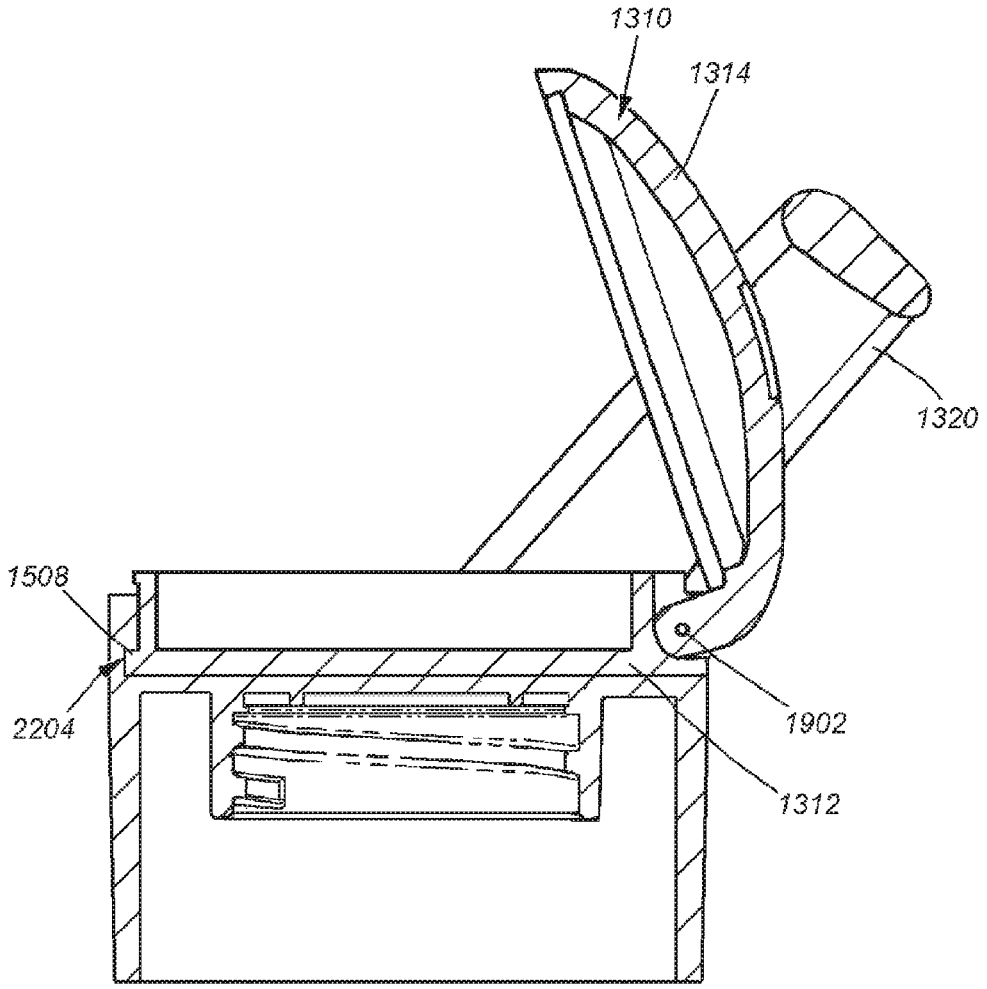
FIG. 24 is a cross sectional view of a cap with installed compact at cross-section line 22-22 showing lid in an open configuration.

FIG. 24 shows the cross section along cross-section line 22-22 shown in FIG. 22 with the lid 1314 depicted rotated about the hinge pin 1902 into an open position allowing a user to access the contents of the compact 1310. As shown in FIG. 23, tooth 1508 cannot be released from the rabbet 2204 by upward force in the direction of force vector L. Tray 1312 remains secured to the cap 1300, allowing a user to selectively disengage the snap fit and access the contents of the compact 1310 while the compact 1310 remains secured to the cap 1300.

Figure 25:
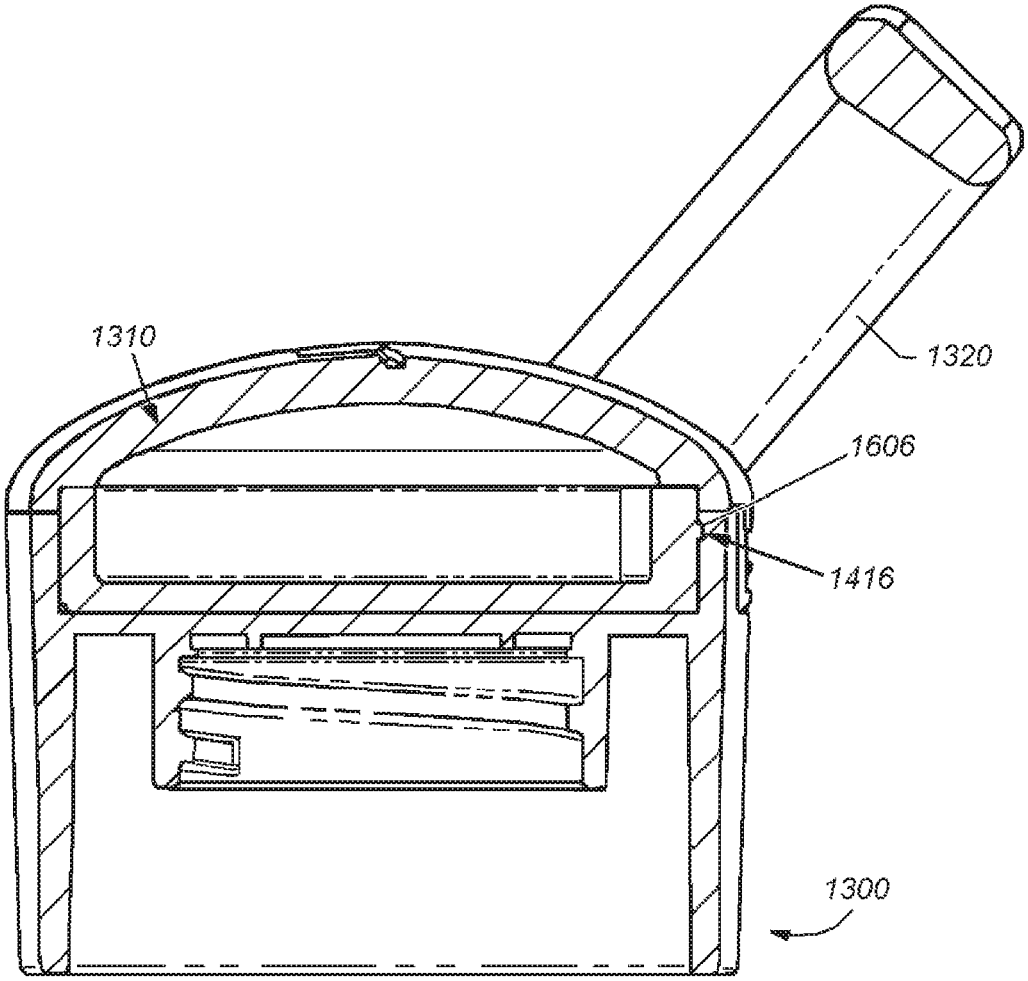
FIG. 25 is a cross sectional view of a cap with installed compact at cross-section line 25-25 showing rear engagement system.

FIG. 25 shows a cross section of the cap 1300 with an installed compact 1310 at cross section line 25-25. A detent 1606 can engage with a notch 1416 within the cavity for securing the compact 1310 to the cap 1300, whereby the detent and the notch are adapted for securing the cap to the tray.

Figure 26:
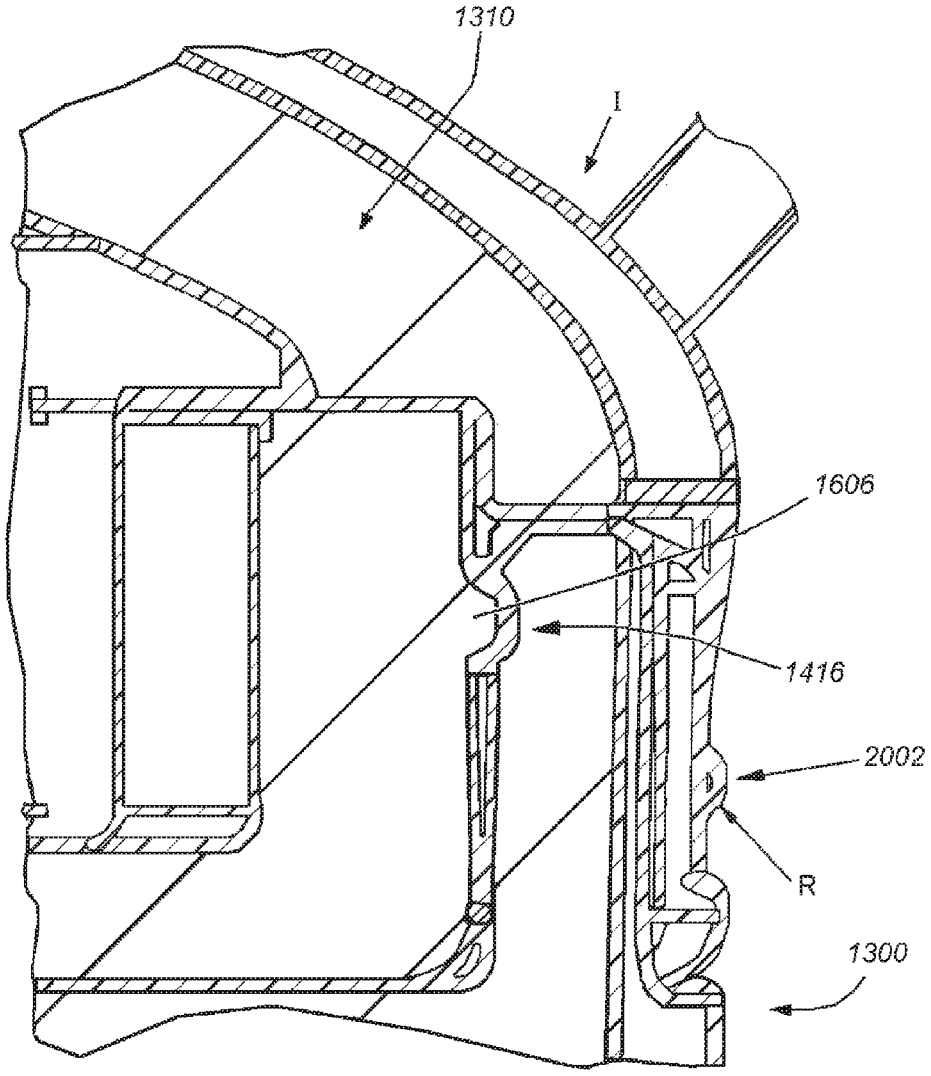
FIG. 26 is an enlarged view of rear engagement system from FIG. 25 showing force vectors used to remove and install a compact in a cap.

FIG. 26 shows an enlarged view of the engagement system shown in FIG. 25. In operation, a user can apply force to the key 2002 of the compact 1310 through the gap 1418 along force vector R to disengage the detents 1606 from the notches 1416 thereby causing a release of the rearward portion of the compact 1310 from the cap 1300 and allowing a user to push the rear of the compact 1310 up and out of the cap 1300. The user can replace a compact 1310 by removing a first compact 1310 and installing a second compact 1310. The user can remove a first compact 1310 by pushing inward or upward on the zone 2002 and pushing the rear of the compact 1310 up and out of the cap. Pushing upwards on the rear of the compact 1310 can result in the front of the tray 1312 pivoting on the front of the top of the rim 1414, thereby disengaging the tooth 1508 from the rabbet 2204 and freeing the compact 1310 from the cap 1300. The user installs a second compact 1310 by first inserting the front portion of the compact 1310 into the cavity of the cap 1300 and engaging the tooth 1508 into the rabbet 2204, and then applying downward force along force vector I to engage the detents 1606 into the notches 1416, thereby securing the second compact 1310 into the cap 1300.

Figure 27:
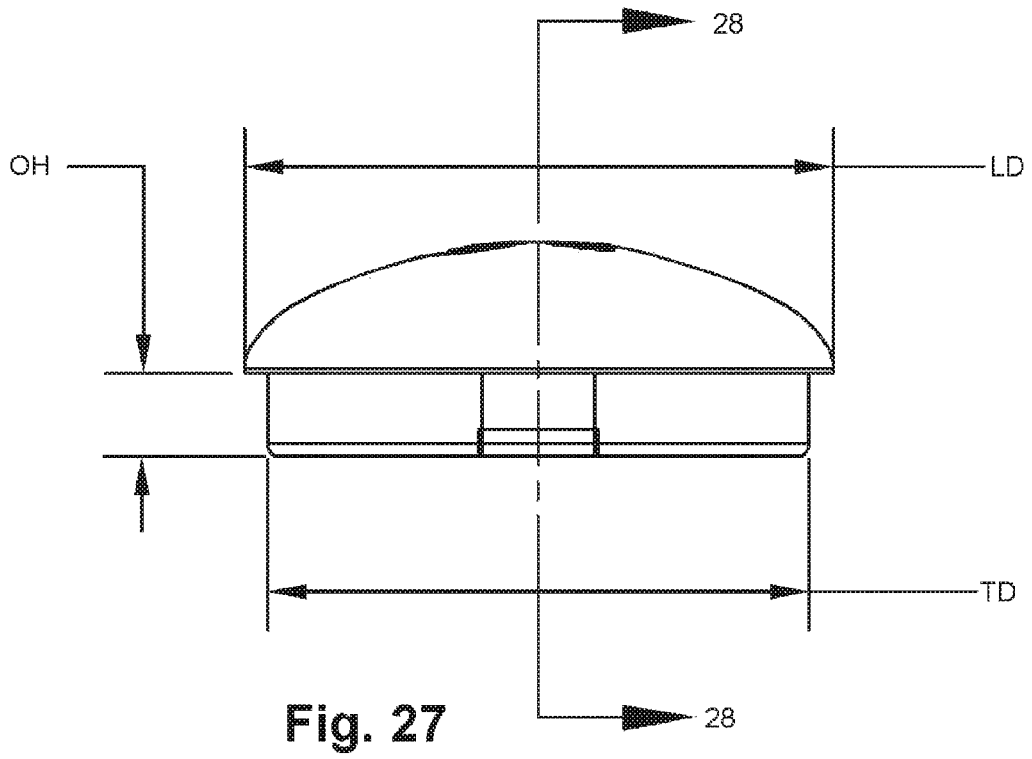
FIG. 27 is a frontal view of a replaceable compact showing cross section lines and dimensions.

FIG. 27 is a front view of compact 1310 with cross section line 28-28. According to the illustrative embodiment, the tray 1312 defines a maximum outer tray diameter TD of approximately of 1.770 inches (4.5 cm) and for example, approximately 1.749 inches (4.4 cm). The distance from the bottom of the tray to the overhang 1822 defines a maximum overhang height OH of approximately 0.260 inch (6.6 mm) (for example approximately 0.266 inch (6.75 mm)). In another example, the lid 1314 defines an outer lid diameter LD that can be approximately 1.907 inches (4.8 cm). It should be obvious that this illustrative example is adapted to be secured in a corresponding cap 1300, and a cap 1300 with different dimensions would secure a compact 1310 with correspondingly different dimensions.

Figure 28:
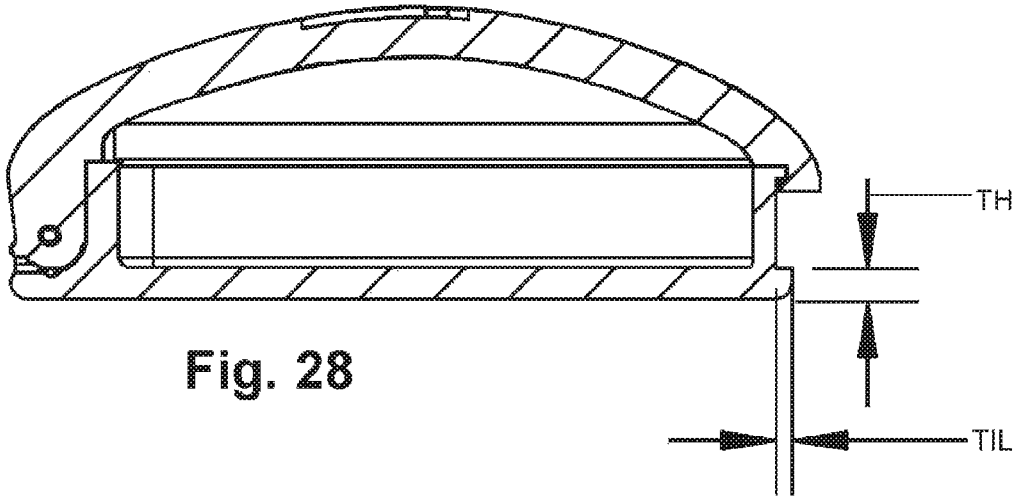
FIG. 28 is a cross sectional view of a replaceable compact showing dimensions of front engagement system components on the compact.

FIG. 28 shows a cross section of compact 1310 at cross section line 28-28. In the illustrative embodiment, the tooth 1508 extends out from the indent 1510 defining a tooth-indent length TIL of a maximum of approximately 0.050 inch (1.27 mm) (for example, approximately 0.036 inch (0.9 mm)). Tooth-indent length TIL, in the illustrative embodiment is partially dependent upon the tray diameter TD of the illustrative embodiment shown in FIG. 27. A tray with a smaller tray diameter TD would have a correspondingly larger tooth-indent length TIL, so that the tooth 1508 can be held firmly within the rabbet 2204. The tooth 1508 defines a tooth height TH of a maximum of approximately 0.085 inch (2.1 mm) and for example approximately 0.079 inch (2 mm). Tooth height TH is partially dependent upon the size of the rabbet 2204 the tooth 1508 is adapted to engage. A larger rabbet 2204 can accommodate a larger tooth height TH and/or tooth-indent length TIL, and a smaller rabbet can accommodate a smaller tooth height TH and/or tooth-indent length TIL.

Figure 29:
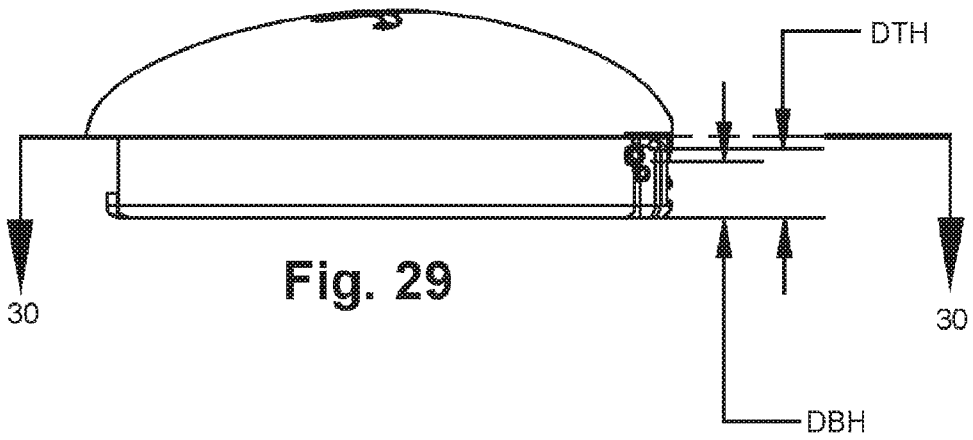
FIG. 29 is a side view of a replaceable compact showing cross section lines and dimensions of rear engagement system components on the compact.

FIG. 29 is a side view of compact 1310. According to the illustrative embodiment, the distance from the bottom of the compact 1310 to the bottom of the detent 1606 defines detent bottom height DBH of a minimum of approximately 0.180 inch (4.6 mm) (for example, approximately 0.187 inch (4.7 mm)). The distance from the bottom of the compact 1310 to the top of the detent 1606 defines a detent top height DTH of a maximum of approximately 0.233 inch (5.9 mm) (for example, approximately 0.226 inch (6.8 mm)). The detent bottom height DBH and detent top height DTH are partially dependent on the size and/or location of the notches 1418 on a corresponding cap 1310 and can vary in dimensions accordingly.

Figure 30:
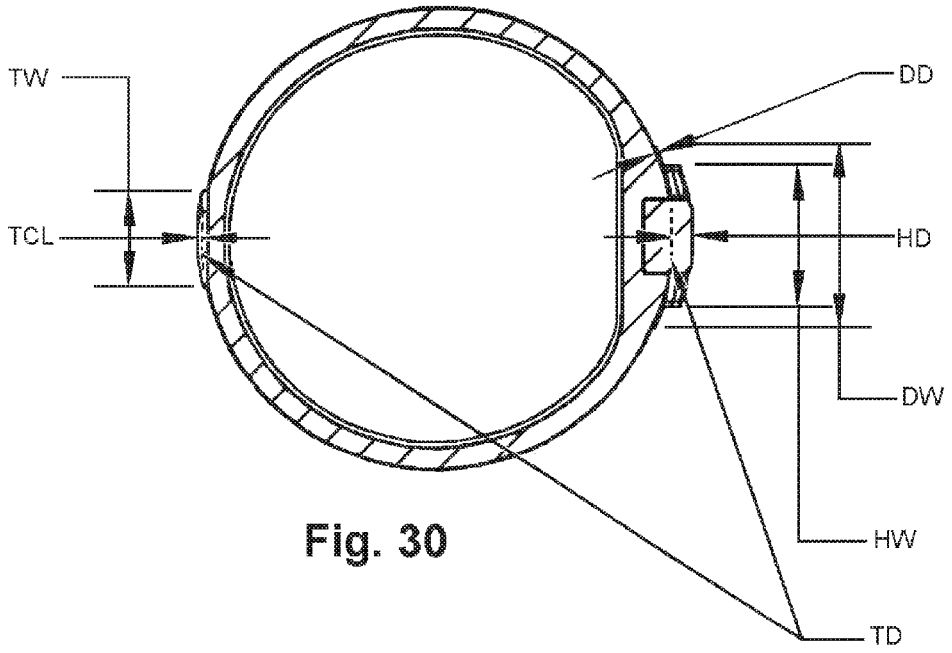
FIG. 30 is a cross sectional view of a replaceable compact showing dimensions.

FIG. 30 shows a cross section of compact 1310 at cross section line 30-30 of FIG. 29. In the illustrative embodiment, the hinge 1316 defines a hinge width HW of a maximum of approximately 0.555 inch (1.4 cm) (for example, approximately 0.547 inch (1.39 cm)). In this embodiment, the hinge width HW is adapted to a corresponding gap 1418, and a narrower gap 1418 can result in a smaller hinge width HW. The outer edges of the two detents 1606 define a detent width DW of a maximum of approximately 0.710 inch (1.8 cm) (for example, 0.702 inch (1.8 cm)). The depth of a detent 1606 defines a detent depth DD of a maximum of approximately 0.027 inch (0.7 mm) (for example, approximately 0.015 inch (0.39 mm)). The maximum detent depth DD can be partially dependent on the depth of the notch 1416, as well as the outer tray diameter TD. As the tray diameter TD decreases, the maximum tooth-indent length TIL and/or detent depth DD increase proportionally so that the outside edges of the compact 1310 can be in the same place. In another embodiment, the hinge 1316 extends out from the rear of the tray 1312 defining a hinge depth HD of approximately 0.079 inch (2 mm). The hinge depth HD and hinge width HW are adapted to a corresponding cap 1310, and a cap with a different sized gap 1418 can secure a tray with a different sized hinge depth HD and/or hinge width HW.

A circle defined by the outer tray diameter TD is depicted in the illustrative embodiment as including the broken lines through the hinge 1316 and the indent 1510, and similar to the illustrative embodiment of FIG. 28, tray diameter TD can be a maximum of approximately 1.770 inches (4.5 cm), and for example approximately 1.749 inches (4.4 cm). The outer perimeter of the tray 1312 can be circular or nearly circular, or alternatively, can have an indent 1510, a furrow 1512, or could be hexagonal, octagonal, or other shapes within the circle defined by the outer tray diameter TD. The distance the tooth 1508 extends radially outward from the circle defined by the outer tray diameter TD (shown in broken lines) defines a tooth-circumference length TCL at the centerline of between approximately 0.030 inch (0.76 mm) and approximately 0.010 inch (0.25 mm), for example approximately 0.016 inch (0.4 mm). Tooth-circumference length TCL in the illustrative embodiment is partially dependent upon the tray diameter TD of the illustrative embodiment shown in FIG. 27. A smaller tray diameter TD would result in a correspondingly larger tooth-circumference length TCL, so that the tooth 1508 is held firmly within the rabbet 2204. In the illustrative embodiment, which is adapted to be secured to a corresponding cap, the tooth 1508 defines a tooth width TW, of a maximum of approximately 0.400 inch (1 cm) (for example, approximately 0.372 inch (0.94 cm)). A tooth 1508 can be off-center, or can comprise a plurality of smaller teeth that need not be symmetrically centered, or can be configured different ways so long as the tooth 1508 is adapted to be engaged in the corresponding rabbet 2204 in the cap 1310.

Note that the various dimensions provided herein are exemplary, and for the purposes of understanding the relationship between functional components of the bottle cap and cosmetic tray/compact described herein. Such dimensions can be varies and rounded in a manner that should be clear to those of skill.

It should be clear that the compact and bottle cap system according to various aspects of the disclosure provides an aesthetically pleasing, versatile and highly functional arrangement for the carrying of materials and/or small items. This system generally provides a sleek way for a user to attach items to be carried to a bottle, thereby decreasing the number of separate items to be carried by the user.

The foregoing has been a detailed description of illustrative embodiments of the invention. Various modifications and additions can be made without departing from the spirit and scope of this invention. Features of each of the various embodiments described above can be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. For example, a small removable mirror can be carried within the lid and above the reservoir. An applicator can be carried within the lid. The cap can be made taller to provide a deeper reservoir. A cap can house a stack of compact trays, the topmost having a lid. Compacts may be sold separately from caps and/or may be sold independently of the lid. Lids may be separate, and may attach to compact trays or bottle caps. Various seals and/or gaskets may be used to protect the contents of the compact. Accordingly, this description is meant to be taken only by way of example, and not to otherwise limit the scope of this invention.

What is claimed is:

1. A cap for a bottle comprising:

a cap body having a base for engaging a top of the bottle and a cavity for receiving a removable tray adapted for containing a dispensable material for use by a user;

a lid hingedly attached to the tray by a hinge, whereby the lid moves selectively between a closed position and an open position; and an interengaging retaining structure that removably secures the tray in the cavity.

2. The cap of claim 1, wherein the hinge is free of springs.

3. The cap of claim 1, wherein the lid further comprises a hinge leaf and a loop within the hinge leaf, and wherein the tray further comprises a hinge anchor, and wherein the hinge comprises the lid, the tray, and a hinge pin, and wherein the hinge is integral.

4. The cap of claim 1, wherein the interengaging retaining structure comprises a rabbet within the cavity, and wherein the interengaging retaining structure further comprises a tooth extending from the tray and adapted to engage within the rabbet, whereby the tooth and the rabbet are adapted for securing the tray to the cap.

5. The cap of claim 4, wherein the interengaging retaining structure further comprises a notch within the cavity, and wherein interengaging retaining structure further comprises a detent extending from the tray and adapted to engage within the notch, whereby the detent and the notch are adapted for securing the tray to the cap.

6. The cap of claim 1, wherein the lid is secured to the tray in the closed position by a snap fit free of non-unitary components.

7. The cap of claim 1, wherein the tray further comprises a septum separating the tray into at least two bowls, the at least two bowls adapted to contain different materials or items from each other.

8. The cap of claim 1, wherein a surface defining the cavity further defines a gap in the cavity for the hinge, thereby setting the rotational position of the tray within the cavity.

9. The cap of claim 1, wherein the cap further comprises a handle extending from the cap, the handle positioned to form a stop to the lid in an open position.

10. The cap of claim 4, wherein the tray is filled with a material or at least one small item.

11. The cap of claim 4, wherein the tray is replaceable, and wherein replacement trays comprise the tooth adapted for securing the tray to the cap.

* * * * *